United States Patent [19]

Baker

[11] 3,948,322

[45] Apr. 6, 1976

[54] MULTIPLE STAGE CEMENTING TOOL WITH INFLATION PACKER AND METHODS OF USE

[75] Inventor: Eugene E. Baker, Duncan, Okla.

[73] Assignee: Halliburton Company, Duncan, Okla.

[22] Filed: Apr. 23, 1975

[21] Appl. No.: 570,602

[52] U.S. Cl. ..... 166/289; 166/154; 166/187

[51] Int. Cl.[2] E21B 33/13; E21B 33/16; E21B 33/127

[58] Field of Search ..... 166/289, 187, 154, 224

[56] References Cited

UNITED STATES PATENTS

| | | | |
|---|---|---|---|
| 1,944,442 | 1/1934 | Manning | 166/289 |
| 3,223,160 | 12/1965 | Baker | 166/289 |
| 3,503,445 | 3/1970 | Cochran et al. | 166/187 |
| 3,524,503 | 8/1970 | Baker | 166/289 |
| 3,768,556 | 10/1973 | Baker | 166/154 |
| 3,768,562 | 10/1973 | Baker | 166/289 |
| 3,811,500 | 5/1974 | Morrisett et al. | 166/154 |

*Primary Examiner*—James A. Leppink
*Attorney, Agent, or Firm*—John H. Tregoning

[57] ABSTRACT

A cementing tool for providing multiple stage cementing of an oil well including a cylindrical outer case, a longitudinally sliding sleeve valve located therein, an inflatable packer assembly disposed about the outer case with annular check valve means interposed between the interior of the inflatable packer and passages communicating with the interior of the cementing tool. Annular sleeve valve means is interposed between the check valve means and the exterior of the tool and is releasable upon the application of a predetermined pressure differential across the sleeve valve means in response to the application of pressure to the interior of the tool to open the interior of the tool to the annulus between the tool and the oil well bore above the inflated packer. The inflatable packer assembly includes a relatively thin, tubular solid metallic membrane having physical properties allowing it to contain the inflatable pressure and to expand as the inflation pressure is applied to the interior of the packer. An annular resilient sealing member is formed on the exterior of the packer member to afford a fluid-tight seal between the inflated packer and the wall of the oil well bore. In one form the sleeve valve apparatus is actuated by the application of hydraulic pressure within the casing string and in an alternate form the sleeve valve is mechanically actuated by a tubing string disposed within the casing string. Various methods of operating the alternate embodiments of the cementing tool are also disclosed.

21 Claims, 17 Drawing Figures

MULTIPLE STAGE CEMENTING TOOL WITH INFLATION PACKER AND METHODS OF USE

BACKGROUND OF THE INVENTION

1. Field of the Invention

The present invention relates generally to improvements in oil and gas well cementing and more particularly, but not by way of limitation, to multiple stage cementing of oil and gas wells.

2. Description of the Prior Art

In preparing oil well bore holes for oil and/or gas production, a most important step involves the process of cementing. Basically, oil well cementing is the process of mixing a cement-water slurry and pumping it down through steel casing to critical points located in the annulus around the casing, in the open-hole below, or in fractured formations.

Cementing a well protects possible production zones behind the casing against salt water flow and protects the casing against corrosion from subsurface mineral waters and electrolysis from outside. Cementing also eliminates the danger of fresh drinking water and recreational water supply strata from being contaminated by oil or salt water flow through the borehole from formations containing those substances. It further prevents oil well blowouts and fires caused by high pressure gas zones behind the casing and prevents collapse of the casing from high external pressures which can build up underground.

A cementing operation for protection against the abovedescribed down-hole condition is called primary cementing. Secondary cementing includes the cementing processes used in a well during its protective life, such as remedial cementing and repairs to existing cemented areas. The present invention is generally useful in both primary and secondary or remedial cementing.

In the early days of oil field production, when wells were all relatively shallow, cementing was accomplished by flowing the cement slurry down the casing and back up the outside of the casing in the annulus between the casing and the borehole wall.

As wells were drilled deeper and deeper to locate petroleum reservoirs, it became difficult to successfully cement the entire well from the bottom of the casing and, therefore, multiple stage cementing was developed to allow the annulus to be cemented in separate stages, beginning at the bottom of the well and working upwardly.

Multiple stage cementing is achieved by placing cementing tools, which are primarily valve ports, in the casing or between joints of casing at one or more locations in the borehole; flowing cement through the bottom of the casing, up the annulus to the lowest cementing tool in the well; closing off the bottom and opening the cementing tool; and then flowing cement through the cementing tool up the annulus to the next upper stage, and repeating this process until all the stages of cementing are completed.

U.S. Pat. Nos. 3,524,503, 3,768,556 and 3,768,562, all to Eugene E. Baker and assigned to Halliburton Company, Duncan, Oklahoma, disclose three forms of cementing tools currently used in multi-stage cementing. These three patents are incorporated herein by reference. The employment of the cementing tools disclosed in U.S. Pat. Nos. 3,768,556 and 3,768,562 and other prior art multiple stage cementing tools is quite satisfactory for many multiple stage cementing applications.

There are, however, cementing applications which necessitate the sealing off of the annulus between the casing string and the wall of the borehole at one or more positions along the length of the casing string. An example of such an application is when it is desired to achieve cementing between a high pressure gas zone and a lost circulation zone penetrated by the borehole. Another application is when it is desired to achieve cementing above a lost circulation zone penetrated by the borehole. A third application occurs when formation pressure of an intermediate zone peentrated by the borehole is greater than the hydrostatic head of the cement to be placed in the annulus thereabove. Still another application occurs when a second stage of cement is to be placed at a distant point up the hole from the top of the first stage of cement and a packer is required to help support the cement column in the annulus. A last example of an application for employment of a cementing packer occurs when it is desired to achieve full hole cementing of slotted or perforated liners.

The prior art contains teachings of the employment of inflatable packers, such as that disclosed in U.S. Pat. No. 3,524,503, and compression type packers for isolating various zones in the annulus during a cementing operation. However, such packer apparatus are subject to unseating, if set with inadequate sealing force, when the weight of the cement column in the annulus thereabove becomes too great. Also, due to irregularities in the wall of the borehole often encountered at the point where the packer is to be applied, compression type packers are often incapable of achieving a sufficient seal between the casing string and the wall of the well bore to achieve satisfactory multiple stage cementing results. Operation of the inflatable packer of U.S. Pat. No. 3,524,503 requires the use of three plugs of progressively increasing diameter thereby limiting the number of cementing stages which may be performed on a casing string of a given diameter.

The present invention overcomes these difficulties by providing a cementing tool either requiring two plugs for operation or mechanically operated from the ground surface and inflatable in response to the application of fluid pressure downwardly through the casing string into the interior of the inflatable packer element to achieve a positive seal between the exterior of the casing and the wall of the well bore prior to the introduction of cement into the annulus above the inflated packer. The latter form of the invention provides means for opening and closing the cementing ports thereof an unlimited number of times during the cementing operation.

SUMMARY OF THE INVENTION

The present invention contemplates a cementing packer tool for cementing through a tubular string in a well bore of the type which includes a tubular housing having at least one port extending through the wall thereof, means for interposing the tubular housing between adjacent sections of the tubular string and securing the housing thereto in communication therewith, sleeve valve means slidably disposed within the tubular housing for alternately opening and closing the port in the tubular housing to fluid flow therethrough in response to manipulation signals from the ground surface, means operatively engaging the sleeve valve means and the tubular housing for releasably maintaining the sleeve valve means in a condition opening the port in the tubular housing, and the means operatively engaging the sleeve valve means and the tubular housing for releasably maintaining the sleeve valve means in a condition closing the port in the tubular housing. The improvement in the tool comprises a tubular inflation packer assembly having an upper end portion and a lower end portion, the lower end portion sealingly engaging the outer periphery of the tubular housing a distance below the port through the wall thereof. The upper end portion defines an annular space between the inner periphery of the inflation packer assembly and the outer periphery of the tubular housing communicating with and extending upwardly from the port through the wall of the tubular housing. At least one port is formed in the upper portion communicating between the annular space and the outer periphery of the tubular inflation packer assembly. The tubular inflation packer assembly includes means for providing an annular seal between the inner periphery of the tubular packer assembly and the outer periphery of the tubular housing intermediate the port formed in the tubular housing and the lower end portion of the inflation packer assembly for allowing one-way downward flow therepast while preventing upward fluid flow therepast. A relatively thin, tubular, solid, metallic membrane is formed in the tubular packer assembly and extends between the lower portion thereof and the upper portion thereof adjacent the means for providing an annular seal and defining a closed annular chamber between the inner periphery of the tubular inflation packer assembly and the exterior of the tubular housing intermediate the lower end portion thereof and the means for providing an annular seal. A tubular resilient packer sealing member is formed on the outer periphery of the solid, metallic membrane. The tubular inflation packer assembly also includes pressure responsive valve means interposed between the port in the tubular housing and the port formed in the upper end portion of the tubular inflation packer assembly for preventing fluid communication between the port in the tubular housing and the port in the inflation packer assembly and, alternately, placing the ports in fluid communication in response to the application of a predetermined pressure differential across the valve means.

Objects and advantages of the various aspects of the present invention will be evident from the following detailed description when read in conjunction with the accompanying drawings.

DESCRIPTION OF THE PREFERRED EMBODIMENTS

Figure 1:
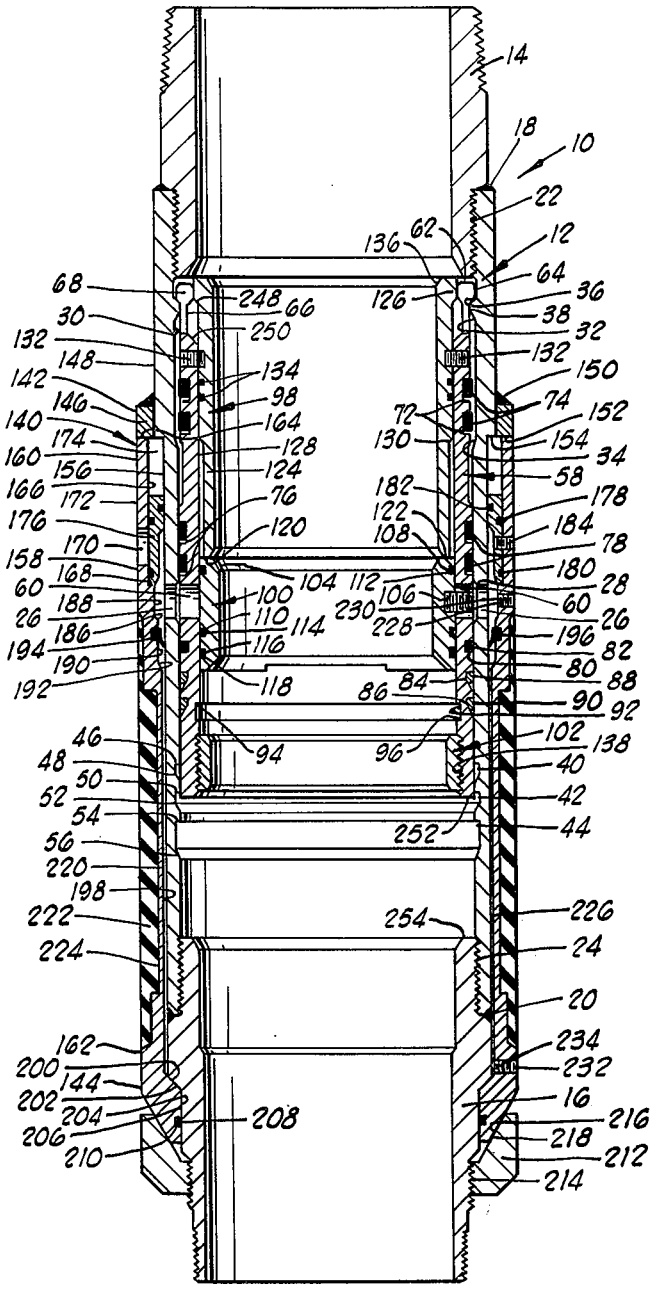
FIG. 1 is a vertical cross-sectional view of the inflation packer apparatus of the present invention.
Figure 2:
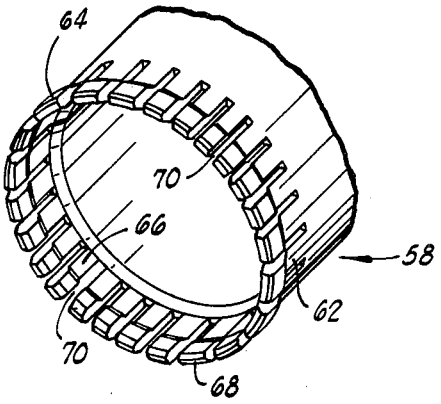
FIG. 2 is a perspective view of the upper end portion of the closing sleeve of the apparatus of FIG. 1.
Figure 3:
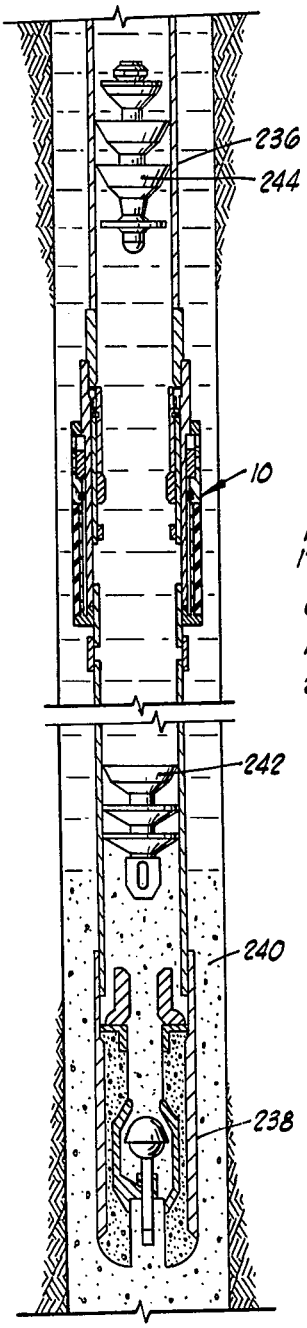
FIGS. 3 through 7 are schematic diagrams illustrating the method of operation of the apparatus of FIG. 1.
Figure 4:
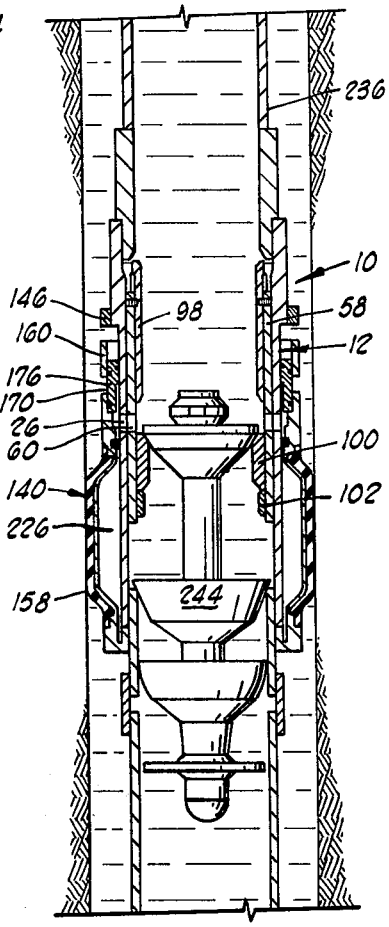
Figure 5:
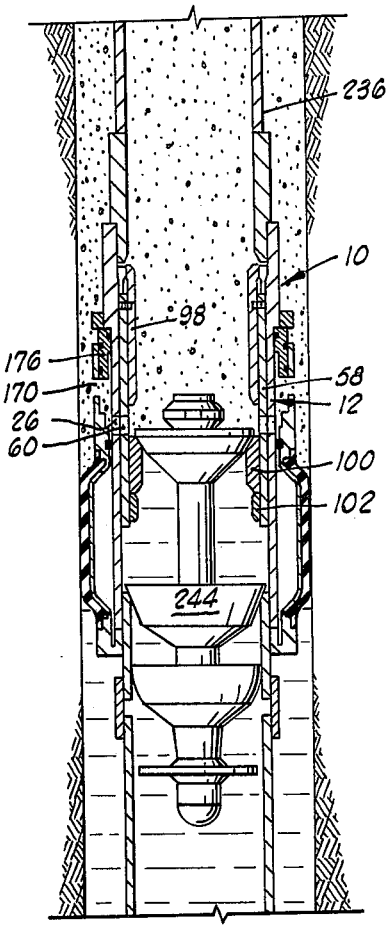
Figure 6:
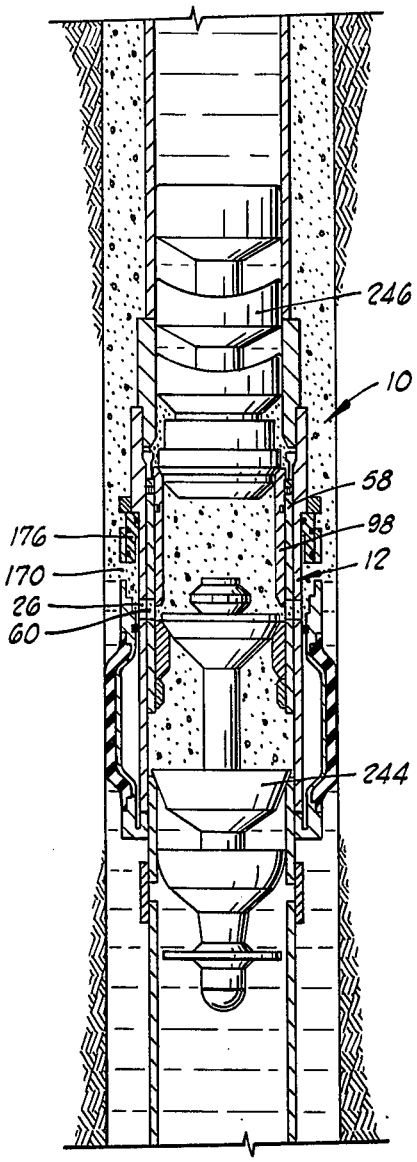
Figure 7:
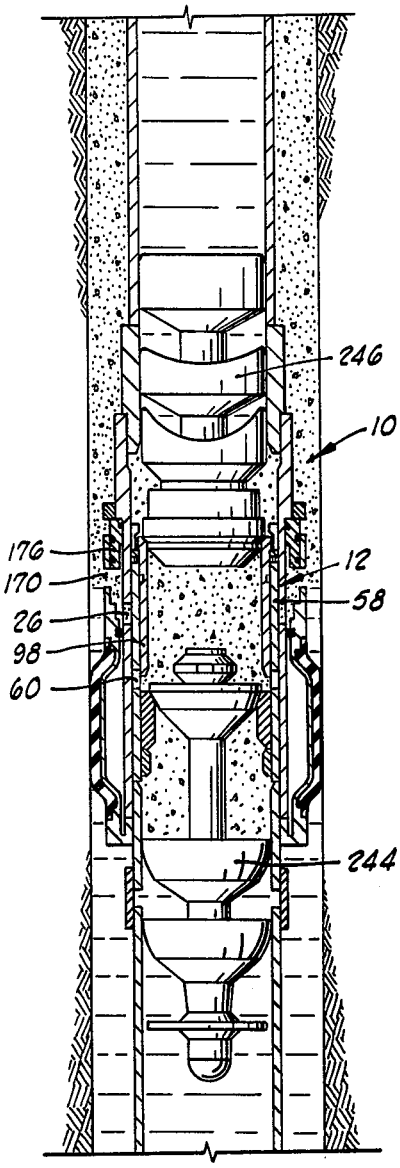

Referring now to the drawings and to FIGS. 1 and 2 in particular, the inflation packer apparatus of the present invention is generally designated by the reference character 10. The apparatus or tool 10 includes a tubular outer case or housing 12 with an upper adapter 14 and a lower adapter 16 secured respectively to the upper and lower end portions of the tubular outer case 12. The adapters 14 and 16 may be connected to the outer case 12 by conventional means such as welding at 18 and 20 as well as threaded connections 22 and 24. The upper adapter 14 and the lower adapter 16 may be threaded at their extreme ends or otherwise arranged to fit between standard sections of casing or other pipe or can be adapted to be welded in place in the casing string necessitating the cutting of the casing and the insertion of the apparatus or tool 10 therein.

The outer case 12 is a cylindrical tubular housing having an inner diameter larger than the inner diameter of the casing string or pipe string in which it is inserted. It is preferably formed of a tough durable material such as steel or stainless steel. Extending through the wall of the outer case 12 are at least one and preferably two or more ports 26. An inner annular recess 28 is formed on the inner surface of the outer case 12 intersecting the ports 26.

Another inner annular recess 30 having sloping or tapered annular shoulders 32 and 34 is formed on the inner surface of the outer casing 12. A sloping or tapered annular shoulder 36 is formed on the inner surface of the outer case 12 above the shoulder 32 and, in conjunction therewith, forms an inwardly extending annular shoulder or rib 38 on the inner surface of the outer case 12.

Three annular recesses 40, 42 and 44 are formed in the inner surface of the lower portion of the outer case 12. The annular recess 40 includes a radial annular upper shoulder 46 and a tapered annular lower shoulder 48. The annular recess 42 includes a radial annular upper shoulder 50 and a tapered annular lower shoulder 52. The lowermost annular recess 44 includes a radial annular upper shoulder 54 and a tapered annular lower shoulder 56.

A tubular cylindrical closing sleeve 58 is slidably disposed within the outer case 12 and has an outer diameter slightly less than the diameter of the inner surface of the outer casing 12. The closing sleeve 58 has an inner diameter substantially equal to that of the casing string or pipe string in which the apparatus or tool 10 is located, and is preferably formed of a tough durable material such as steel or stainless steel.

The closing sleeve 58 includes at least one and preferably two or more ports 60 extending through the wall thereof and preferably radially aligned with the ports 26 of the outer case 12. The closing sleeve 58 is equipped at its upper end with a collet ring 62 formed by an outer annular ridge 64 formed on the closing sleeve 58 and by an inner annular recess 66 formed on the inner surface of the closing sleeve 58. The collet ring 62 comprises a plurality of collet fingers 68 formed in the upper end portion of the closing sleeve 58 by circumferentially equispaced machined grooves 70 cut in the upper end portion of the closing sleeve 58 and extending through the annular ridge 64 and the annular recess 66 as shown in FIG. 2.

A pair of annular grooves 72 are formed in the exterior of the closing sleeve 58 adjacent the upper end portion thereof and contain a respective pair of annular sealing members 74 therein for providing a fluid-tight seal between the closing sleeve 58 and the outer case 12. A second pair of annular grooves 76 are formed in the outer surface of the closing sleeve 58 above and adjacent the ports 60. Annular sealing members 78 are disposed within the annular grooves 76 and provide a sliding fluid-tight seal between the closing sleeve 58 and the inner surface of the outer case 12. An annular groove 80 is formed in the outer surface of the closing sleeve 58 below and adjacent the ports 60. An annular sealing member 82 is disposed within the annular groove 80 and provides a sliding fluid-tight seal between the closing sleeve 58 and the inner surface of the outer case 12. The annular sealing members 74, 78 and 82 are preferably formed of an elastomeric material but may also be formed of a suitable resilient synthetic material if desired.

Annular grooves 84 and 86 are formed in the outer surface of the closing sleeve 58 adjacent to and spaced below the annular groove 80. Each annular groove 84 and 86 includes a radial annular upper shoulder and a tapered annular lower shoulder, each annular shoulder communicating with the outer surface of the closing sleeve 58. Expanding lock rings 88 and 90 are disposed respectively in the annular grooves 84 and 86. The lock rings 88 and 90 are wedge-shaped in cross-section with radial annular upper end faces and tapered annular lower surfaces sized and shaped to closely engage the respective tapered annular lower shoulders of the grooves 84 and 86. The lock rings 88 and 90 are compressed into the respective annular grooves 84 and 86. The lock rings 88 and 90 are adapted to expand partially out of the respective annular grooves 84 and 86 when either of the lock rings moves adjacent any of the annular recesses 40, 42 or 44 formed in the outer case 12. Because of the abutment of the radial upper end face of the lock ring with the radial annular shoulder of the adjacent annular recess, the closing sleeve 58 is prevented from moving upwardly within the outer case 12. The mutual wedging action between the tapered annular lower surfaces of the lock rings 88 and 90 with the tapered annular lower shoulders of the grooves 84 and 86 urges the lock rings radially outwardly in response to any upward force applied to the closing sleeve 58. This locking action provides the locked closed feature of the tool 10 which occurs after cementing has been completed. Initially, the outer annular ridge 64 of the collet fingers 68 of the collet ring 62 abut the sloping or tapered annular shoulder 36 of the outer case 12 to prevent premature downward movement of the opening sleeve 58 before cementing is completed through the tool 10.

The closing sleeve 58 further includes an inner annular groove 92 formed in the inner surface thereof below the ports 60. The annular groove 92 includes upper and lower radial annular shoulders 94 and 96 which communicate with the inner surface of the closing sleeve 58.

Located concentrically within the closing sleeve 58 are a releasing sleeve 98, an opening sleeve 100 and a sleeve retainer 102. The opening sleeve 100 is in the form of a cylindrical collar snugly fitting within the closing sleeve 58, and having a tapered annular plug seat 104 formed on the upper end thereof. The opening sleeve 100 is initially positioned within the closing sleeve 58 covering ports 60 and 26 as shown in FIG. 1. The opening sleeve 100 is releasably retained in the closed position over the ports 60 and 26 by means of shear pins 106 threadedly engaged in the closing sleeve 58 and received in corresponding cavities formed in the opening sleeve 100 in substantially the same plane in which the ports 60 and 26 lie. The shear pins 106 have been rotated in FIG. 1 for purposes of illustration only.

The opening sleeve 100 includes annular grooves 108 and 110 formed in the outer surface thereof above and below the shear pins 106. Annular sealing members 112 and 114 are disposed respectively within the annular grooves 108 and 110 and provide a sliding fluid-tight seal between the opening sleeve 100 and the closing sleeve 58. The opening sleeve 100 further includes an annular groove 116 formed in the outer surface thereof below the annular groove 110. An expanding lock ring 118 is compressed into the annular groove 116 and is adapted to expand partially into inner annular groove 92 of the closing sleeve 58 when the annular grooves 116 and 92 are aligned. This structure provides a locking arrangement between the opening sleeve 100 and the closing sleeve 58 when the opening sleeve 100 has been moved downwardly relative to the closing sleeve 58 into the open-port cementing position.

Positioned directly above the opening sleeve 100 within the closing sleeve 58 is the cylindrical tubular releasing sleeve 98 having a lower end face 120 abutting the upper end face 122 of the opening sleeve 100. The releasing sleeve 98 includes a narrowed cylindrically shaped skirt 124 formed on its lower end portion and a radially outwardly extending annular shoulder 126 formed on the upper end portion thereof. The outer surface of the skirt 124 and the inner surface of the closing sleeve 58 define an annular cavity 128 extending between the lower end face 120 and a tapered annular shoulder 130 formed on the releasing sleeve 98.

The annular shoulder 126 contacts the collet fingers 68 maintaining them in their outward position in abutment with the outer case 12 at the tapered annular shoulder 36 thereby preventing the closing sleeve 58 from moving downwardly and closing off the ports 60. The releasing sleeve 98 is releasably attached initially to the closing sleeve 58 by shear pins 132 threadedly secured in the wall of the closing sleeve 58 and received in corresponding cavities formed in the outer surface of the releasing sleeve 98. A sliding fluid-tight seal is provided between the releasing sleeve 98 and the closing sleeve 58 by means of annular sealing members 134 carried in annular grooves formed in the outer surface of the releasing sleeve 98 intermediate the cavities receiving the shear pins 132 and the tapered annular shoulder 130. A tapered annular shoulder 136 is formed on the upper inner edge of the releasing sleeve 98 to form a plug seat on the upper end of the releasing sleeve.

The sleeve retainer 102 is a circular ring fixedly secured to the lower interior end of the closing sleeve 58.

As shown in FIG. 1, the sleeve retainer 102 is secured to the closing sleeve 58 by closely fitted threaded connection 138. The sleeve retainer 102 is adapted and located within the closing sleeve 58 to abut the lower end of the opening sleeve 100 when the opening sleeve is in its lowermost position relative to the closing sleeve 58, and to further aid the lock ring 118 in preventing excessive downward movement of the opening sleeve 100 relative to the closing sleeve 58. The sleeve retainer 102 also provides an additional force transmitting means from the opening sleeve 100 to the closing sleeve 58.

It is desirable to form the releasing sleeve 98, opening sleeve 100 and sleeve retainer 102 of a relatively easily drilled material such as aluminum, aluminum alloy, brass, bronze, or cast iron, so that these parts may be readily drilled out of the apparatus or tool 10 after cementing is completed, thereby providing a fully open passage through the apparatus or tool 10.

A tubular inflation packer assembly 140, having an upper end portion 142 and a lower end portion 144, is disposed about the tubular outer case or housing 12. The inflation packer assembly 140 includes a tubular back up ring 146 at the upper end portion 142 thereof. The back up ring 146 is secured to the cylindrical outer surface 148 of the outer case 12 by suitable means such as a continuous annular weld as shown at 150. The lower end face 152 of the back up ring 146 lies in substantial radial alignment with an annular shoulder 154 formed on the outer periphery of the outer case 12 and communicating between the cylindrical outer surface 148 and a second cylindrical outer surface 156 formed on the outer periphery of the outer case 12 and having a diameter less than the diameter of the cylindrical outer surface 148.

The tubular inflation packer assembly 140 further includes a tubular inflatable packer unit 158 disposed about the outer case 12. The packer unit 158 includes an upper end portion 160 and a lower end portion 162. An upper end face 164 is formed on the upper end portion 160 and abuts the lower end face 152 of the back up ring 146. A cylindrical inner surface 166 extends between the upper end face 164 and an annular shoulder 168 formed on the interior of the packer unit 158 longitudinally adjacent the ports 26 formed in the walls of the outer case 12. At least one, and preferably two or more ports 170 are formed in the upper end portion 160 of the packer unit 158 and communicate between the cylindrical inner surface 166 and the cylindrical outer surface 172 thereof.

The annular shoulder 154 and cylindrical outer surface 156 of the outer case 12 and the cylindrical inner surface 166 and the annular shoulder 168 of the packer unit 158 define an annular cavity 174 between the packer unit 158 and the outer case 12 which is intersected by the ports 170. An annular piston or sleeve valve member 176 is longitudinally slidably disposed within the cavity 174. The valve member 176 carries upper and lower outer annular sealing members 178 and 180 and an upper inner annular sealing member 182 which provide sliding sealing engagement between the valve member 176 and the outer and inner walls of the annular cavity 174. The valve member 176 is initially releasably secured within the annular cavity 174 by means of one or more shear pins 184 threadedly secured to the wall of the packer unit 158 and received in corresponding cavities formed in the outer surface of the valve member 176. In this initial position the lower end of the valve member 176 is preferably in abutment with the annular shoulder 168 of the packer unit 158. It is deemed preferable to fill the cavity 174 above the valve member 176 with grease.

A second annular shoulder 186 is formed on the interior of the packer unit 158 adjacent the lower edges of the ports 26 in the outer case 12. A cylindrical inner surface 188 communicates between the annular shoulders 168 and 188 of the packer unit 158. A cylindrical inner surface 190 extends downwardly from the annular shoulder 186 and communicates with a third annular shoulder 192 formed on the interior of the packer unit 158. An annular groove 194 is formed in the cylindrical inner surface 190 and carries a resilient annular check valve member 196 therein. The annular check valve member 196 may be suitably formed of an elastomeric material and includes a downwardly extending annular lip which sealingly engages the cylindrical outer surface 156 of the outer case 12. The annular check valve member 196 provides for downward fluid flow therepast between the outer case 12 and the packer unit 158 while preventing reverse upward fluid flow therepast.

A cylindrical inner surface 198 extends downwardly from the annular shoulder 192 and has a diameter slightly greater than the diameter of the surface 156 of the outer case 12. The cylindrical surface 198 communicates with tapered annular shoulder 200 which mutually engages a corresponding tapered annular shoulder 202 formed on the outer periphery of the lower adapter 16. The annular shoulder 200 communicates with a cylindrical inner surface 204 formed on the lower end portion 162 of the packer unit 158 which surface is slidably received around a cylindrical outer surface 206 formed on the outer periphery of the lower adapter 16 and communicating with the annular shoulder 202 thereof. An annular sealing member 208 is carried in an annular groove 210 formed in the cylindrical surface 204 and provides a fluid-tight seal between the lower end portion 162 of the packer unit 158 and the cylindrical surface 206 of the lower adapter 16. The lower end portion 162 of the packer unit 158 is retained in engagement with the lower adapter 16 by means of an internally threaded nut 212 which is threadedly engaged with external threads 214 formed on the lower adapter 16. A tapered annular shoulder 216 formed on the nut 212 engages a corresponding tapered annular shoulder 218 formed on the lower end portion 162 of the packer unit 158.

The upper end portion 160 and the lower end portion 162 of the packer unit 158 are interconnected by an intermediate portion 220. The inflatable packer unit 158 is preferably formed of a suitable metal such as aluminum, aluminum alloy, steel or stainless steel. The intermediate portion 220 is formed into a relatively thin, tubular, solid or impervious membrane whose physical properties permit the intermediate portion 220 to expand without rupture during the inflation of the inflatable packer unit 158.

A tubular resilient packer sealing member 222 is disposed about and suitably bonded to the outer surface 224 of the intermediate portion 220 and extends between the upper and lower end portions 160 and 162 of the inflatable packer unit 158. The packer sealing member 222 is preferably formed of an elastomeric material and may, if desired, be formed of a suitable resilient synthetic resinous material for special applications as desired.

It will be seen that the structure thus far defined provides a sealed, annular cavity 226 between the exterior of the outer case 12 and lower adapter 16 and the inner periphery of the inflatable packer unit 158 intermediate the annular check valve member 196 and the annular sealing member 208. An internally threaded port 228 extends through the wall of the upper end portion 160 of the inflatable packer unit 158 at a point adjacent to and above the annular check valve member 196. The port 228 is closed by an externally threaded, removable plug 230. A second internally threaded port 232 extends through the wall of the lower end portion 162 of the inflatable packer unit 158 communicating with the sealed annular cavity 226 at the lower end thereof. The port 232 is closed by a removable, externally threaded plug 234.

After assembly of the apparatus 10 as shown in FIG. 1, the apparatus is preferably laid on its side with the ports 228 and 232 positioned on top of the tool 10. The plugs 230 and 234 are removed and a suitable lightweight oil is pumped into the port 228 until the cavity 226 is completely filled with the oil. The plugs 230 and 234 are then installed in respective ports 228 and 232 to achieve a fluid-tight seal trapping the oil within the cavity 226. It may be desirable to employ Teflon tape as a sealing element between the plugs 230 and 234 and the ports 228 and 232.

In typical operation, referring now to FIGS. 3 through 7, the inflation packer apparatus or tool 10 is placed in the casing string or pipe string 126 before it is run in the hole. It may be inserted between the standard threaded section of the pipe at the desired locations of cementing stages to be performed. A number of cementing stages are possible with this tool as long as each of the opening and releasing sleeves of each cementing tool in the pipe string has a smaller inner diameter than the cementing tool next above it.

After the casing string 236 is in the hole, the first or lowermost stage of cementing may be accomplished through the lower end portion 238 of the string 256 and up the annulus 240. A wiper plug 242 is inserted behind the first stage of cement slurry and displacing or working fluid of approximately the same specific gravity as the cement slurry is pumped behind the wiper plug to displace the cement slurry from the lower end portion 238 of the string 236.

After a precalculated amount of displacing fluid, sufficient to fill the string from the lower end portion 238 to the cementing tool next above, has been pumped into the string 236, and opening plug 244 is inserted into the casing string and is flowed downwardly through the casing string 236 to seat on plug seat 104 of the opening sleeve 100 thereby providing a fluidtight seal across the opening through the tool 10. Alternatively, a plug or ball can be dropped through the fluid in the casing string 236 to engage the seat 104 and seal off the tool 10. A precalculated quantity of displacing or working fluid sufficient to inflate the inflatable packer unit 158 of the tool 10 is flowed behind the opening plug 244.

Pressure sufficient to shear the shear pins 106 is then applied to the displacing fluid in the casing string 236, which pressure, acting through plug 244, shears pins 106 and forces the opening sleeve 100 downwardly relative to the tool 10, exposing ports 60 and 26 to the pressurized displacing fluid. The displacing fluid then flows through the ports 60 and 26 and downwardly past the resilient annular check valve 196 into the sealed annular cavity 226 to inflate the inflatable packer unit 158 until the packer sealing member 222 engages the wall of the wellbore and seals off the annulus 240. The apparatus 10 is then in the condition illustrated in FIG. 4. Lock ring 118 has expanded into the annular groove 92 thereby preventing any upward movement of the opening sleeve 100 relative to the closing sleeve 58 when the lock ring 118 engages the radial annular shoulder 94 of the annular groove 92. The upper end portion 160 of the inflatable packer unit 158 has moved downwardly from the back up ring 146 to accommodate the expansion of the inflated inflatable packer unit 158.

The pressure applied to the displacing fluid in the casing string 236 is increased until the differential pressure between the displacing fluid within the casing string and the pressure in the annulus acting on the annular piston valve member 176 reaches a predetermined level at which point the shear pins 184 are sheared. When the shear pins 184 are sheared, the annular valve member 176 moves upwardly within the annular cavity 174 thereby opening the ports 170 and placing the interior of the casing string 236 in communication with the annulus 240 above the inflated inflatable packer unit 158 via the ports 60, 26 and 170.

At this point a precalculated quantity of cement slurry is pumped through open ports 60, 26 and 170 in the annulus above the inflated packer to complete the second stage of cementing of the casing string 236. Behind this precalculated quantity of cement slurry a closing plug 246 is inserted within the casing string 236 and is pumped behind the cement slurry followed by displacing fluid. The closing plug 246 seats in the tapered annular shoulder 136 of the releasing sleeve 198 thereby closing off the passage through the tool 10. When the fluid pressure differential across the closing plug 246 reaches a predetermined value, the shear pins 132 are sheared allowing the releasing sleeve 98 to move downwardly out of abutting contact with the collet ring 62. The annular cavity 128 allows cement trapped between the plugs 244 and 246 to continue to exit through ports 60, 26 and 170 thereby preventing a hydraulic lock therebetween. Continued pressure applied to closing plug 246 forces the releasing sleeve 98 to its lowermost position with the annular shoulder 248 thereof abutting the annular shoulder 250 formed on the inner periphery of the closing sleeve 58.

A sufficient predetermined pressure force transmitted through the closing plug 246 acts downwardly on the releasing sleeve 98, through the annular shoulder 136, abutting annular shoulder 248 of the releasing sleeve 98 with the annular shoulder 250 of the closing sleeve 58 thereby transmitting force to the closing sleeve 58, overcoming the spring force of the collet fingers 68 and allowing collet ring 62 to be compressed inwardly, moving past the annular shoulder 36 and annular rib 38 and downwardly therefrom. This action results in the movement of the ports 60 downwardly and out of registration with the ports 26 and passes the annular sealing members 78 below the ports 26 thereby providing a fluid-tight seal between the ports 26 and the interior of the apparatus 10. At this point the expanding lock rings 88 and 90 in the annular grooves 84 and 86 have moved into positioned adjacent the annular recesses 40 and 42 and expanded partially thereinto thereby preventing any upward movement of the closing sleeve 58 relative to the outer case 12. Downward travel of the closing sleeve 58 within the outer case 12 is limited by the lower end face 252 of the closing sleeve 58 abutting the upper end face 254 of the lower adapter 16. It should be noted that before the closing sleeve 58 is moved downwardly, the plugs 244 and 246 have become stationary with respect to each other and there is no more possibility of hydraulic lock occurring between them.

The closing of the ports 26 completes this cementing stage and the next cementing stage can begin. After the final stage is completed, the bore passage obstructions consisting of sleeves 98, 100, and 102, plugs 244 and 246, and the cement between the plugs 244 and 246, may be readily drilled out leaving the bore passage completely open and unobstructed for subsequent operations therethrough.

It should be noted that even after closing of the ports 26, the hydrostatic pressure exerted by the column of cement and other fluids in the annulus 240 above the inflated packer assembly 140 is continuously applied to the annular cavity 226 and maintained by the check valve member 196 resulting in a firm grip and seal between the packer unit 158 and the well bore.

DESCRIPTION OF THE EMBODIMENT OF FIG. 8

Referring again to the drawings, and to FIG. 8 in particular, an alternate preferred embodiment of the inflation packer apparatus of the present invention is generally designated by the reference character 300. The apparatus or tool 300 includes a tubular outer case or housing 302, an inner valve sleeve 304 telescopically disposed within the outer case 302, an upper body member 306 and a lower body member 308. The outer case or housing 302 includes one or more ports 310 extending through the wall thereof in the area where the valve sleeve 304 is slidably located. The valve sleeve 304 includes matching ports 312 extending through the wall thereof and arranged so that the ports 312 will align with the ports 310 when the valve sleeve 304 is in its uppermost position within the outer case 302. This position is achieved when the annular upper end face 314 of the valve sleeve 304 abuts the lower annular end face 316 of the upper body member 306.

The valve sleeve 304 and the tubular outer case 302 possess appropriately sized inner and outer diameters so that the valve sleeve 304 fits just loosely enough within the tubular outer case 302 to allow it to slide within the outer case 302. The valve sleeve 304 has substantially the same inner diameter as that of the standard casing to which the apparatus 300 is to be secured to form a casing string, thereby providing a full opening tool.

The tubular outer case 302 may be fixedly secured in fluid-tight communication to the upper and lower body members 306 and 308 by means of threaded connections 318 and 320, respectively, and continuous annular welds 322 and 324, respectively.

The outer case 302 includes a radially inwardly extending, cylindrically shaped inner surface 326 communicating at its upper and lower end portions with tapered annular shoulders 328 and 330, respectively. An inner annular recess 332 is formed on the cylindrical inner surface 334 of the outer case 302 intersecting the ports 310 formed therein. A corresponding outer annular recess 336 is formed in the cylindrical outer surface 338 of the valve sleeve 304 intersecting the ports 312 formed therein. When the tool 300 is assembled, the ports 312 are preferably positioned in exact alignment with the ports 310, but it is contemplated that rotation of the sleeve 304 may occur within the outer case 302 and the ports 310 and 312, while being in the same diametral plane, and might cause a restriction in cement flow therethrough. Thus, the annular recesses 332 and 336 provide relatively unrestricted fluid communication through the ports 310 and 312 should these ports not be exactly in line when the sleeve 304 is moved to its open position abutting the annular end face 316 of the upper body member 306.

Figure 8:
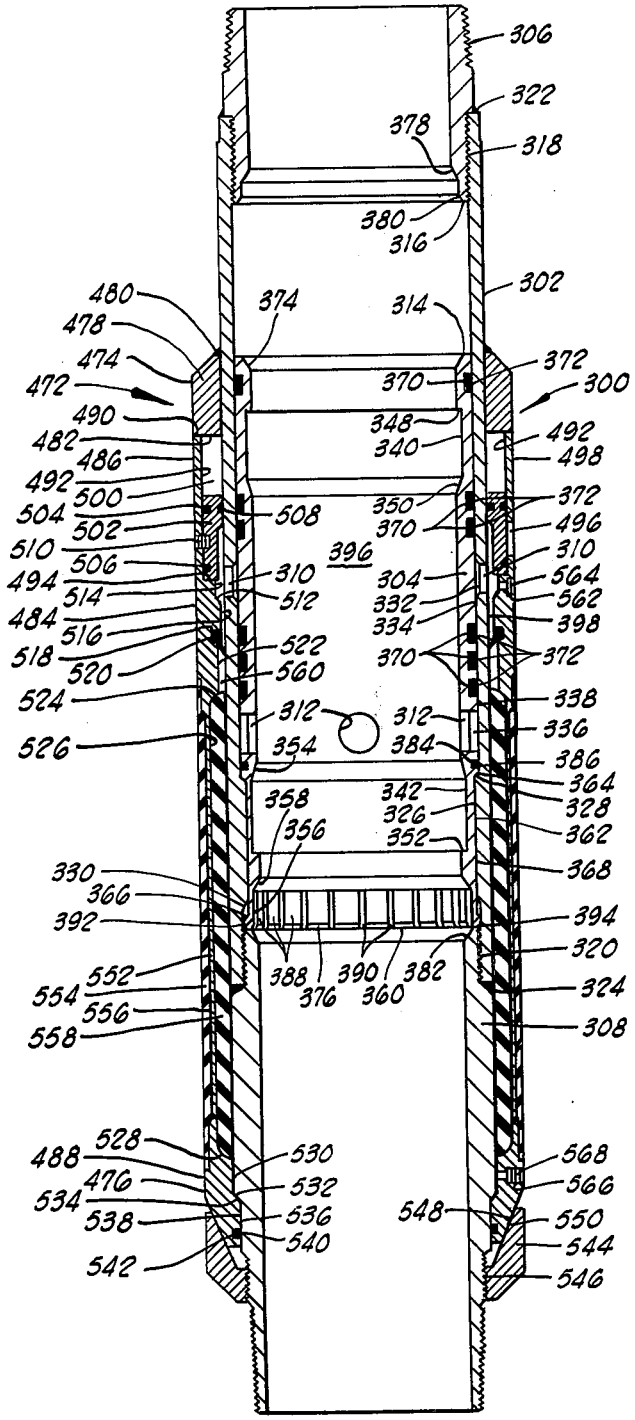
FIG. 8 is a vertical cross-sectional view of an alternate full opening embodiment of the inflation packer apparatus of the present invention.
Figure 11:
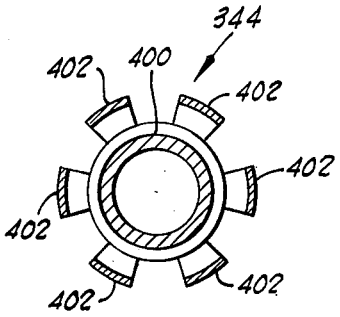
FIG. 11 is a cross-sectional view taken along line 11—11 of FIG. 9.
Figure 9:
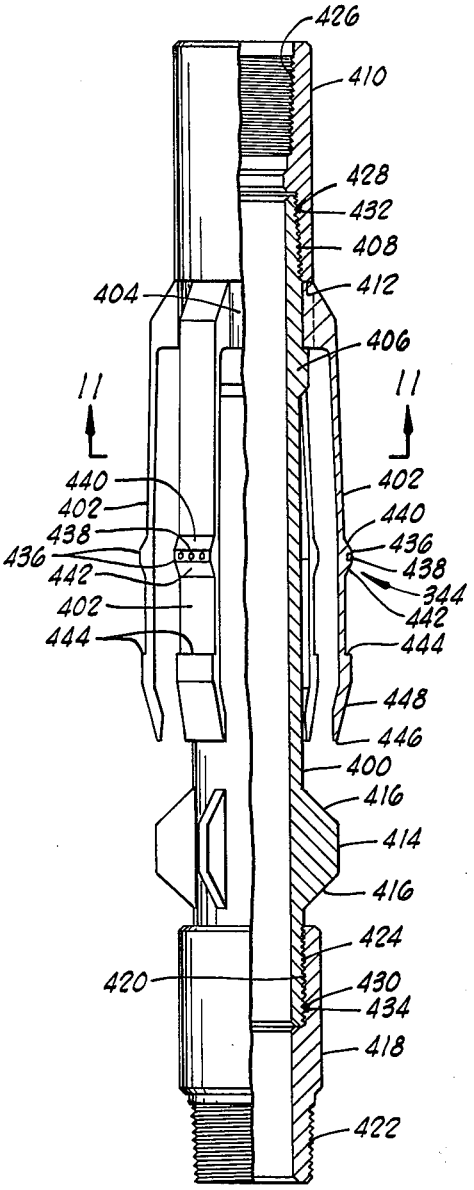
FIG. 9 is a partial vertical cross-sectional view of the opening positioner for use with the apparatus of FIG. 8.
Figure 10:
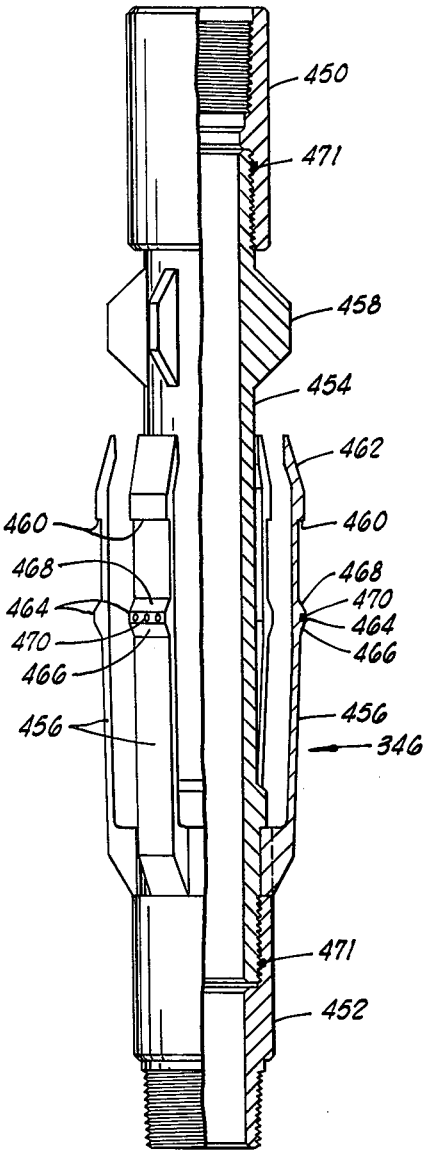
FIG. 10 is a partial vertical cross-sectional view of the closing positioner for use with the apparatus of FIG. 8.

The valve sleeve 304 is provided with upper and lower inner annular recesses 340 and 342, respectively, for engagement with the opening positioner 344 (see FIG. 9), and the closing positioner 346 (see FIG. 10). The upper recess 340 includes a radially inwardly extending annular shoulder 348 lying in a plane normal to the longitudinal axis of the valve sleeve 304 and a tapered annular shoulder 350. The lower recess 342 includes a radially inwardly extending annular shoulder 352 lying in a plane normal to the longitudinal axis of the valve sleeve 304 and a tapered annular shoulder 354. the valve sleeve 304 also includes an annular enlargement 356 at its lower end comprising a radially outwardly extending tapered annular shoulder 358 and a skirt 360. In addition, the valve sleeve 304 is further provided with a broad, relatively shallow external annular recess 362 in which the cylindrically shaped inner surface 326 of the outer case 302 may be received as shown in FIG. 8. The recess 362 is defined by tapered annular upper and lower shoulders 364 and 368 and a cylindrically shaped outer surface 368 extending therebetween.

Annular grooves 370 are formed in the cylindrical outer surface 338 of the valve sleeve 304 each carrying an annular seal member 372 therein which provides a sliding fluid-tight seal between the valve sleeve 304 and the cylindrical inner surface 334 of the outer case 302. The valve sleeve 304 further includes tapered or beveled annular shoulders 374 and 376 formed, respectively, on the upper and lower ends thereof to facilitate movement of the opening and closing positioners 334 and 346 through the sleeve 304. The upper body member 306 is also provided with beveled or tapered annular shoulders 378 and 380 to provide easy tool string movement therethrough, and lower body member 308 is provided with a beveled or tapered annular shoulder 382 for easier passage of a tool string therethrough.

An annular groove 384 is formed in the cylindrical outer surface 338 of the valve sleeve 304 intermediate the outer annular recess 336 and the tapered annular shoulder 364 and carries an annular sealing member 386, preferably an O-ring, therein to provide a sliding fluid-tight seal between the valve sleeve 304 and the cylindrical inner surface 334 and the cylindrical inner surface 334 of the outer case 302.

Collet fingers 388 are formed about the lower circumference of the valve sleeve 304 by machining circumferentially equispaced slots 390 longitudinally in the skirt 360 of the valve sleeve 304. This provides a spring clip structure on the skirt 360 through the inherent resilience of each collet finger 388.

The cylindrically shaped outer surface 368 of the valve sleeve 304 extends partially along each collet finger 388 and defines at the tapered annular lower shoulder 366, a radially outwardly extending annular ridge 392 on the skirt 360 and on each collet finger 388. The tapered annular shoulder 366 on the ridge 392 abuts the tapered annular shoulder 330 communicating with the cylindrically shaped inner surface 326 to prevent premature opening of the apparatus 300 which could otherwise occur through inadvertent movement of the valve sleeve 304 upwardly within the outer case 302.

The spring force maintaining the valve sleeve 304 in the lowermost position within the outer case 302 can be varied by adjusting the spring tension of the collet fingers 388. This may be done by machining larger or smaller slots 390 in the skirt 360, or by making the collet fingers 388 thicker or thinner by changing the machined size of the annular enlargement 356. Thus, the valve sleeve 304 can be prevented from sliding until a preset or predetermined force is applied to the sleeve 304, which force will overcome the spring tension in the collet fingers 388. A typical opening tension for use in the employment of the apparatus 300 would be approximately twenty thousand pounds force.

The collet fingers 388 also each include a beveled or tapered end face 394 on the exposed lower end thereof. When the apparatus 300 is in the fully open position with the valve sleeve 304 at its uppermost position within the outer case 302, lining up the ports 310 with the ports 312, the faces 394 on the collet fingers 388 will be positioned above the tapered annular shoulder 328 of the outer case 302 and in proximate relation thereto. The abutment of the end faces 394 with the annular shoulder 328 prevents premature or unwanted closure of the valve structure of the apparatus or tool 300. The same force required to overcome the tension of the collet fingers 388 to move the valve sleeve 304 upwardly from its closed position will be required to move it downwardly from its open position.

A preferred embodiment of the opening positioner 344 is illustrated in FIG. 9. The opening positioner 344 is employed in the engagement and movement of the inner valve sleeve 304 from a closed position in the tubular outer case 302 to an open position, whereby the ports 310 are lined up with the ports 312 and fluid communication between the inner bore portion 396 of the valve sleeve 304 to the cylindrical outer surface 398 of the outer case 302 is achieved.

The opening positioner 344 includes a mandrel body 400 which carries a plurality of spring arms 402 fixedly secured to a spring collar 404 which encircles the mandrel body 400 and fits snugly against an annular shoulder 406 formed on the body 400.

Attached to the mandrel body 400 by threaded connection 408 is an upper shoulder 410 which abuts the spring collar 404 at an annular shoulder 412 of the adapter 410 and which serves to secure the collar 404 firmly and snugly against the annular shoulder 406.

Below the arms 402 on the body 400 are located a plurality of drag lugs 414 projecting radially outwardly from the body 400 and having sloping faces 416 formed on the upper and lower ends thereof with each drag lug 414 being aligned longitudinally with a respective spring arm 402.

At the lower end of the body 400 is a lower adapter 418 in the form of a threaded collar having internal threads 420 and external threads 422 formed thereon. The adapter 418 is secured to the mandrel body 400 by mutual threaded engagement of the internal threads 420 with external threads 424 formed on the lower end of the mandrel body 400. The upper and lower adapters 410 and 418 are inserted in a standard tubing or drill string and connected to the tubing ends by means of the internal threads 426 of the upper adapter 410 and the external threads 422 of the lower adapter 418. Annular seals 428 and 430 are positioned in annular grooves 432 and 434 in the upper and lower adapters 410 and 418, respectively, to provide a fluid-tight seal between the mandrel body 400 and the upper and lower adapters 410 and 418.

Each spring arm 402 is provided with a radially outwardly extending shoulder 436 in which is imbedded one or more carbide buttons 438. Each shoulder 436 includes sloped upper and lower surfaces 440 and 442 which act as wedges or cams to drive the respective spring arm 402 radially inwardly when contacting projections formed on the interior of the valve sleeve 304 and the upper body member 306. The shoulders 436 act as centralizers for the positioner 344 to keep it centered within the casing. The buttons 438 reduce friction wear on the positioner 344.

Each spring arm 402 also includes a radially aligned or perpendicular shoulder 444 which is adapted to engage the corresponding annular shoulder 348 within the valve sleeve 304 and allows the valve sleeve 304 to be pulled up into the open position by lifting up on the drill string in which the opening positioner 344 is connected.

The tips 446, each located at the free end of a respective spring arm 402, project inwardly toward the axis of the opening positioner 344 and are located on a smaller radius than the outer surface of the drag lugs 414. Thus, the drag lugs 414 provide a centering and shielding function for the spring arms 402 as the positioner 344 enters the valve sleeve 304. The sloping face 448 formed on the lower end of each spring arm 402 provides a wedging or cam action which pushes the respective spring arm 402 radially inwardly when an inner projection within the valve sleeve 304 is encountered by the face 448, thereby allowing the positioner 344 to travel downwardly through the valve sleeve 304 relatively unimpeded.

The spring arms 402 are thus arranged so that, on downward movement through the valve sleeve 304, no part of the arms 402 will engage the valve sleeve 304 sufficiently enough to move the valve sleeve 304 downwardly by overcoming the spring tension of the collet fingers 388 on the cylindrically shaped inner surface 326 of the outer case 302. Thus, downward movement of the opening positioner 344 has no effect on the valve mechanism of the apparatus 300, and the positioner 344 can pass downwardly entirely through the valve sleeve 304 without changing the porting orientation between the valve sleeve 304 and the outer case 302.

The shoulder 436 on each spring arm 402 also serves the function of a releasing cam when the respective spring arm 402 is engaged in the valve sleeve 304 and has moved the valve sleeve 304 to the uppermost position within the outer case 302, thereby placing the prots 310 and 312 in registration to open the valve mechanism. In order that the opening positioner 344 may be pulled upwardly out of the valve sleeve 304 after the valve mechanism has been opened, the shoulders 436 are located on the spring arms 402 so that when the valve sleeve 304 is at the top of its travel, the shoulders 436 abut the tapered or beveled annular shoulders 380 and 378 of the upper body member 306 thereby driving the shoulders 436 and the spring arms 402 radially inwardly resulting in the disengagement of the shoulders 444 of the arms 402 from the annular shoulder 348 of the valve sleeve 304.

Referring now to FIG. 10, the closing positioner 346 is illustrated therein. The closing positioner 346 comprises the identical elements of the opening positioner 344 but with a different orientation of the elements.

The closing positioner 346 has an upper adapter 450, lower adapter 452, mandrel body 454, spring arms 456 and drag lugs 458. The only difference between the closing positioner 346 and the opening positioner 344 is that the mandrel body 454 containing the spring arm and spring collar assembly, has been removed from the upper and lower adapters, rotated end for end 180°, and reconnected to the adapters. The free ends of the spring arms 456 of the closing positioner 346 extend upwardly whereas the spring arms 402 of the opening positioner 344 extend downwardly. Each of the spring arms 456 includes an actuating shoulder 460 near the respective tip 462 thereof. These shoulders 460 are arranged to engage the annular shoulder 352 of the valve sleeve 304 as the closing positioner 456 moves downwardly through the apparatus or tool 300. The abutment of the shoulders 460 against the annular shoulder 352 in the valve sleeve 304 allows the valve sleeve to be pushed downwardly into a closed position from the open position. When the valve sleeve 304 reaches the closed position, the shoulders 464, each including sloping surfaces 466 and 468 thereon, formed on each spring arm 456 engage the tapered or beveled annular shoulder 382 of the lower body 308 which provides a wedging or cam action forcing the spring arms 456 radially inwardly toward the mandrel body 454 and out of engagement with the valve sleeve 304 at the annular shoulder 352.

Each shoulder 464 also includes carbide friction buttons 470 on the outer surface to reduce drag and unnecessary wear on the spring arms 456. Drag lugs 458 also shield the spring arms 456 as do the lugs 414 for the spring arms 402 on the opening positioner 344. Annular seals 471 provide fluid-tight sealing engagement between the mandrel body 454 and the upper and lower adapters 450 and 452.

The inflation packer apparatus 300 further includes a tubular inflation packer assembly 472, having an upper end portion 474 and a lower end portion 476, which is disposed about the tubular outer case or housing 302. The inflation packer assembly 472 includes a tubular back up ring 478 at the upper end portion 474 thereof. The back up ring 478 is secured to the cylindrical outer surface 398 of the outer case 302 by suitable means such as a continuous annular weld as shown at 480. The lower end face 482 of the back up ring 478 extends radially outwardly from the cylindrical outer surface 398 of the outer case 302.

The tubular inflation packer assembly 472 further includes a tubular inflatable packer unit 484 disposed about the outer case 302. The packer unit 484 includes an upper end portion 486 and a lower end portion 488. An upper end face 490 is formed on the upper end portion 486 and abuts the lower end face 482 of the back up ring 478. A cylindrical inner surface 492 extends between the upper end face 490 and an annular shoulder 494 formed on the interior of the packer unit 484 longitudinally adjacent the ports 310 formed in the wall of the of the outer case 302. At least one, and preferably two or more ports 496 are formed in the upper end portion 486 of the packer unit 484 and communicate between the cylindrical inner surface 492 and the cylindrical outer surface 498 thereof.

The cylindrical outer surface 398 of the outer case 302, the lower end face 482 of the back up ring 478 and the cylindrical inner surfaces 492 of the packer unit 484 define an annular cavity 500 between the packer unit 484 and the outer case 302 which is intersected by the ports 496. An annular piston or sleeve valve member 502 is longitudinally slidably disposed within the cavity 500. The valve member 502 carries upper and lower outer annular sealing members 504 and 506 and an upper inner annular sealing member 508 which provide sliding sealing engagement between the valve member 502 and the outer and inner walls of the annular cavity 500. The valve member 502 is initially releasably secured within the annular cavity 500 by means of one or more shear pins 510 threadedly secured to the wall of the packer unit 484 and received in corresponding cavities formed in the outer surface of the valve member 502. In this initial position, the lower end of the valve member 502 is preferably in abutment with the annular shoulder 494 of the packer unit 484. It is deemed preferable to fill the cavity 500 above the valve member 502 with grease.

A second annular shoulder 512 is formed on the interior of the packer unit 484 adjacent the lower edges of the ports 310 in the outer case 302. A cylindrical inner surface 514 communicates between the annular shoulders 494 and 512 of the packer unit 484. A cylindrical inner surface 516 extends downwardly from the annular shoulder 512 and communicates with an annular groove 518 formed on the interior of the packer unit 484. The annular groove 518 carries a resilient annular check valve member 520 therein. The annular check valve member 520 may be suitably formed of an elastomeric material and includes a downwardly extending annular lip which sealingly engages the cylindrical outer surface 398 of the tubular outer case 302. The annular check valve member 520 provides for downward fluid flow therepast between the outer case 302 and the packer unit 484 while preventing reverse upward fluid flow therepast.

A cylindrical inner surface 522 extends downwardly from the annular groove 518 and check valve member 520 to intersect an annular shoulder 524 formed on the interior of the packer unit 484. A cylindrical inner surface 526 communicates with and extends downwardly from the annular shoulder 524 to intersect an annular shoulder 528 formed on the interior of the lower end portion 488 of the packer unit 484. A cylindrical inner surface 530 communicates with the annular shoulder 528 and extends downwardly to intersect a tapered annular shoulder 532 which mutually engages a corresponding tapered annular shoulder 534 formed on the outer periphery of the lower body member 308. The annular shoulder 532 communicates with a cylindrical inner surface 536 formed on the lower end portion 488 of the packer unit 484, which surface is slidably received around a cylindrical outer surface 538 formed on the outer periphery of the lower body member 308 and communicating with the annular shoulder 534 thereof. An annular sealing member 540 is carried in an annular groove 542 formed in the cylindrical surface 536 and provides a fluid-tight seal between the lower end portion 488 of the packer unit 484 and the cylindrical surface 538 of the lower body member 308. The lower end portion 488 of the packer unit 484 is retained in engagement with the lower body member 308 by means of an internally threaded nut 544 which is threadedly engaged with external threads 546 formed on the lower body member 308. A tapered annular shoulder 548 formed on the nut 544 engages a corresponding tapered annular shoulder 550 formed on the lower end portion 488 of the packer unit 484.

The upper and lower end portions 486 and 488 of the tubular inflatable packer unit 484 are interconnected by an intermediate portion 552. The inflatable packer unit 484 is preferably formed of a suitable metal such as aluminum, aluminum alloy, steel or stainless steel. The intermediate portion 552 is formed into a relatively thin, tubular, solid or impervious membrane of such suitable metal the physical properties of which permit the intermediate portion 552 to expand without rupture during the inflation of the inflatable packer unit 484.

A tubular resilient packer sealing member 554 is disposed about and suitably bonded to the outer surface 556 of the intermediate portion 552 and extends between the upper and lower portions 486 and 488 of the inflatable packer unit 484. The packer sealing member 554 is preferably formed of an elastomeric material and may, if desired, be formed of a suitable, resilient synthetic resinous material or the like for special applications as desired.

A resilient tubular member 558 is positioned within the packer unit 484 along the cylindrical inner surface 526 between the annular shoulders 524 and 528 thereof. The resilient tubular member 558 is preferably formed of an elastomeric material and is preferably adhered or bonded to the cylindrical inner surface 526 of the packer unit 484. The tubular member 558 is employed when it is necessary to provide support for the metallic membrane 552 to withstand high hydrostatic pressure. It will be understood that such a resilient tubular member may be employed with the apparatus 10, described above, if desired.

It will be seen that the tubular inflation packer assembly 472 thus far defined provides a sealed, annular cavity 560 between the exterior of the outer case 302 and lower body member 308 and the inner periphery of the inflatable packer unit 484 intermediate the annular check valve member 520 and the annular sealing member 540. An internally threaded port 562 extends through the wall of the upper end portion 486 of the packer unit 484 at a point adjacent to and above the annular check valve member 520. The port 562 is closed by an externally threaded removable plug 564. A second internally threaded port 566 extends through the wall of the lower end portion 488 of the inflatable packer unit 484 communicating with the sealed annular cavity 560 at the lower end thereof. The port 566 is closed by a removable, externally threaded plug 568.

After assembly of the apparatus 300 as shown in FIG. 8, the apparatus is preferably laid on its side with the ports 562 and 568 positioned on top of the tool 300. The plugs 564 and 568 are removed and a suitable lightweight oil is pumped into the port 562 until the cavity 560 is completely filled with the oil. The plugs 564 and 568 are then installed in the respective ports 562 and 566 to achieve a fluid-tight seal trapping the oil within the cavity 560. It may be desirable to employ Teflon tape as a sealing element between the plugs 564 and 568 and the respective ports 562 and 566.

Figures 12, 13, 14, 15, 16, 17:
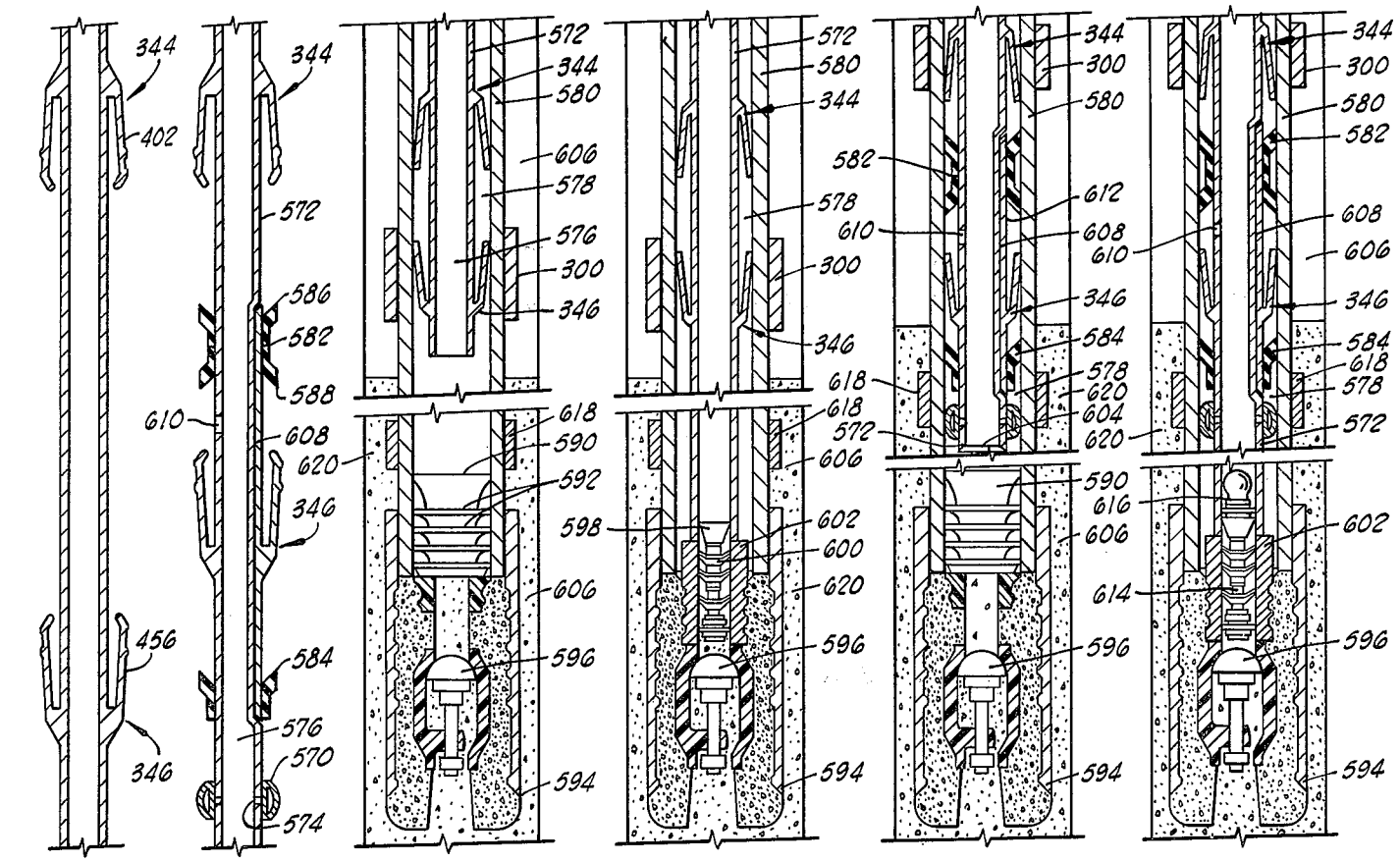
FIG. 12 is a schematic illustration of a drill string containing the opening and closing positioners for use with the valve sleeve of the apparatus of FIG. 8.
FIG. 13 is a schematic illustration of a drill string containing the opening and closing positioners, isolation packers, and a circulating valve for use with the valve sleeve of the apparatus of FIG. 8.
FIGS. 14 through 17 are schematic diagrams of the full opening inflation packer apparatus of FIG. 8 illustrating several different methods of operation thereof.

Referring now to FIG. 12, the opening positioner 344 is adapted to be placed in a drill string by threading it between two standard joints of drill pipe or tubing. The closing positioner 346 is placed in the drill string also, below the opening positioner 344, and can be any desired distance below the casing positioner 344, depending upon the length of the pipe or tubing placed between the positioners 344 and 346. The apparatus illustrated in FIG. 12 and further illustrated in FIGS. 13–17, may be advantageously employed with the inflation packer apparatus 300 of the present invention. In FIGS. 13, 16 and 17, a circulating valve 570 is located on the exterior of a drill string or tubing string 572 and is slidably movable on the drill string to open and close ports 574 which extend through the wall of the drill string 572 and provide fluid communication between the interior bore 576 of the drill string and the annulus 578 between the casing 580 and the drill string 572. The circulating valve 570 can be one of the commercially available valves suitable for such use and which can be actuated from the ground surface when desired.

Also particularly useful with the apparatus 300 under certain circumstances are isolation packers 582 and 584. The packer 582 is the upper packer and comprises resilient sealing cups 586 and 588 which are circular cups formed of an elastomeric material or the like which is capable of sealingly engaging the interior of the casing 580. The cup 586 on the packer 582 faces upwardly and is capable of sealing flow of fluids in a downward direction, which downward flow presses into the cup 586 and spreads it out into sealing contact with the casing 580. The cup 588 faces downwardly and is suitable for sealing against upward flow in the same manner as the cup 586 seals against downward flow.

The packer 584 primarily comprises a single resilient elastomeric cup which is concave upwardly for preventing downward flow thereby. The packer 584 does not prevent upward flow passing it through the annulus 578.

FIGS. 14-17 illustrate other equipment which is used with the multi-stage cementing apparatus 300, including a standard cementing plug 590 with a plurality of circumferential elastomeric wiper cups 592 formed on the plug. Also utilized is a standard commercially available cementing float shoe 594 having a common check valve arrangement 596 in the passage therethrough. The cementing shoe 594 is fixedly secured to the casing 580 at its lower end. The cementing plug 590 is designed to pass snugly within the casing 580 and is used to separate two different types of fluids, drilling or displacement fluid and cement, and also wipes the interior of the casing clean as it passes downwardly through the casing.

Another system, as shown in FIG. 15, uses a different form of latch-down plug 598. This plug is designed to pass down the drill string 572 rather than through the casing and is therefore necessarily of smaller diameter. The latch-down plug 598 includes elastomeric wiper collars 600 formed thereon in a manner similar to that previously described for the cementing plug 590.

A sealing adapter 602 is located on the lower end of the tubing string 572 and serves to retain the latch-down plug 598 within the tubing string 572 and provides a fluid-tight seal closing off the lower end of the tubing string 572.

The corresponding apparatus employed to seal off the tubing string 572 when the cementing plug 590 and packers 582 and 584 are used in the casing 580 is a bull plug 604 which is passed down through the drill string or tubing string at the desired instant and seats at the lower end of the drill string 572 thereby sealing it off.

Referring now to FIG. 14, a simple method of operating the present invention includes the cementing of the first or lower stage through the casing with the drill string out of the hole. One or more inflation packer apparatus or tools 300 will have been placed in the casing string 580 with the inner valve sleeves 304 in their closed state at the desired cementing points for the different stages before the casing 580 is positioned in the well. A cementing plug 594 will have been positioned on the lower end of the lowermost section of casing.

The lower stage of the annulus is then cemented by flowing a precalculated amount of cement slurry down the casing, through the shoe 594 and up the annulus 606. A cementing plug 590 is placed in the casing at the end of the cement flow and then working or displacement fluid is flowed into the casing behind the plug 590, forcing all cement in the casing to flow through the shoe 594 and into the annulus 606. When the plug 590 seats in the shoe 594 and seals off the passage therethrough, check valve 596 prevents back flow of cement through the shoe. Immediately after the plug 590 seats, pressure in the casing 580 begins to rise sharply, indicating to the operator at the ground surface that the first stage of cementing is completed, and the second stage is ready to begin.

The drill string or tubing string 572, containing the opening positioner 344 and the closing positioner 346, is then placed into the casing and lowered until the closing positioner 346 and the opening positioner 344 have passed through the lowermost tool 300. During the running of the drill string 572, the inner bore 576 of the drill string remains open to allow fluid flow upwardly into the drill string as it goes into the casing, thereby facilitating placement of the drill string in the casing.

After the opening positioner 344 has passed downwardly through the closed apparatus 300, the drill string is then picked up just enought to pull the opening positioner 344 through the valve sleeve 304. As it passes upwardly through the valve sleeve 304, the opening positioner engages the valve sleeve 304 by abutment of the positioner shoulders 444 against the sleeve shoulder 348 which allows the required lifting force to be applied to the valve sleeve 304 overcoming the spring tension of the collet fingers 388 and moving the valve sleeve 304 upwardly until the ports 312 are in alignment with the ports 310. At this point the shoulders 436 on the spring arms 402 of the opening positioner 344 engage the beveled annular shoulders 380 and 378 of the upper body member 306 forcing the spring arms 402 radially inwardly and disengaging the shoulders 444 from the shoulder 348.

The valve sleeve 304 is then held snugly in the open position by the collet fingers 388 abutting the annular shoulder 328. The drill string 572 and closing positioner 346 can then be withdrawn from the valve sleeve 304 until the lower end of the drill string is approximately even with the ports 310 and 312.

Displacing fluid is then pumped down the drill string and through the ports 312 and 310 and downwardly past the resilient annular check valve 520 into the sealed annular cavity 560 to inflate the inflatable packer unit 484 until the packer sealing member 554 seals off the annulus 606. The upper end portion 486 of the adjustable packer unit 484 has moved downwardly from the back up ring 478 to accommodate the expansion of the inflated inflatable packer unit 484.

The pressure applied to the displacing fluid in the casing is increased until the differential pressure between the displacing fluid within the casing string and the pressure in the annulus 606 adjacent and acting on the annular piston valve member 502 reaches a predetermined level at which point the shear pins 510 are sheared. When the shear pins 510 are sheared, the annular valve member 502 moves upwardly within the annular cavity 500 thereby opening the ports 496 and placing the interior of the casing string 580 in communication with the annulus 606 above the inflatable packer unit 484 via the ports 312, 310 and 496.

At this point a precalculated quantity of cement slurry is pumped from the drill string and through the ports 312, 310 and 496 into the annulus 606 above the inflated packer to complete the second stage of cementing of the casing string 580.

The working or displacement fluid, which for instance could be drilling mud or the like, remaining in the casing from below the drill string 572 down to the top of the cementing plug 590, acts as a fluid cushion which directs the cement slurry through the ports 312, 310 and 496 instead of down the casing. Only a negligible amount of the cement slurry will mix with or enter the working or displacement fluid and this will settle harmlessly to the bottom of the casing string.

After the second stage of cementing is completed, the drill string 572 is set down a sufficient distance within the casing string 580 to pass the closing positioner 346 through the valve sleeve 304 without allowing the opening positioner 344 to also pass therethrough. In order to facilitate this, the drill string was initially assembled at the surface with a sufficient length of drill pipe between the opening positioner 344 and the closing positioner 346. For instance, a thirty foot long section of drill pipe would normally be of sufficient length.

As the closing positioner 346 passes downwardly through the valve sleeve 304, the actuating shoulders 460 of the arms 456 engage the annular shoulder 352 in the valve sleeve 304 which allows a sufficient amount of downward force to be applied to the valve sleeve 304 to overcome the tension of the collet fingers 388 and move the valve sleeve 304 downwardly within the outer case 302 into a closed position. This closing movement is felt at the ground surface as a sharp jerk as the collet fingers release and allow the valve sleeve to drop a short distance and then come to an abrupt stop. The drill string can then be lifted to the third cementing stage, if any, or removed from the well if desired. Thus it is obvious that as many stages of cementing as desired can be accomplished with this method, merely by inserting the desired number of tools 300 in the casing string and appropriately maneuvering the drill string or tubing string supporting the opening and closing positioners.

It should be noted that it may be advantageous to temporarily attach the valve sleeve 304 to the tubular outer case 302 of the apparatus 300 by suitable shear means to prevent premature opening of the valve sleeve mechanism when going into the hole of performing operations other than cementing. When it is desired to open the apparatus or tool 300, the shear means can then be sheared by applying sufficient additional lifting force over that required to contract the collet fingers 388 to thereby shear the shear means and allow the valve sleeve 304 to move upwardly into the open position.

It should also be clearly understood that with the valve sleeve 304 in a closed position, the closing positioner 346 can pass downwardly through the valve sleeve 304 relatively unhindered due to the fact that the beveled annular shoulder 382 of the lower body member 308 engages the shoulders 464 on the spring arms 456 thereby forcing the spring arms radially inwardly and preventing engagement of the shoulder 460 with the annular shoulder 352 in the valve sleeve 304.

FIG. 15 involves a modification of the method of cementing shown in FIG. 14. In the method illustrated in FIG. 15, all cementing, including the first stage, is performed through the drill string and the cement slurry is substantially isolated from the inside of the casing 580.

In FIG. 15 a drill string 572 is lowered into the casing 580 to be cemented. The drill string carries a sealing adapter 602 at its lower end for contacting and providing fluid-tight communication between the drill string and the cementing shoe 594. After the drill string is lowered into sealing contact with the cementing shoe 594, a predetermined amount of cement slurry is pumped down the drill string, out the shoe 594, and into the annulus 606 around the casing 580. A latch-down plug 598 is placed behind the cement slurry and working or displacement fluid is pumped in behind the plug to insure that the entire charge of cement is delivered to the desired annulus area. The latch-down plug 598 has wiper collars 600 formed thereon and made of an elastomeric material and designed to clean the drill string inner surface of cement slurry.

After the first stage of cement has flowed through the shoe 594, the latch-down plug 598 engages and latches to the shoe 594 and seals its passageway off. This indicates to the operator at the ground surface by the rapidly increasing drill string pressure that the first stage is cemented and that the following stages can then be completed as described in the method above in conjunction with FIG. 14.

Referring now to FIG. 16, another method of employing the apparatus 300 of the present invention for multi-stage cementing is illustrated. This method is advantageous for cementing when the annulus around the casing does not contain fluid all the way to the ground surface. Under such circumstances, the fluid in the annulus outside the casing becomes balanced with the fluid between the casing and the drill string by flowing out of the inner annulus 578 between the drill string and the casing and into the outer annulus 606 between the casing and the well bore. Thus, when a cement slurry is flowed out of the drill string and into the casing it will pass up the inside of the casing as well as pass through the cementing tool 300 and into the outer annulus 606. This will result in as much cement being positioned in the inner annulus 578 between the drill string and the casing as it is in the outer annulus 606 between the casing and the well bore. Normally, the inner annulus 578 is full of fluid which prevents cement from passing up the inner annulus and forces it into the outer annulus, and the outer annulus is full of working fluid also.

Under some conditions, such as encountered in a lost circulation formation, where the inflation packer apparatus 300 of the present invention is especially useful, the outer annulus fluid may be flowed into a cavity or porous permabel formation, leaving the outer annulus partially or completely empty.

The use of the inflation packer apparatus 300 of the present invention in conjunction with the bull plug 604, isolation packers 582 and 584 and circulating valve 570 as disclosed in FIG. 16, allows a multiple stage cementing operation to be performed when the outer annulus cannot be filled with working fluid.

In operation, the first stage of cementing is accomplished through the casing 580 without having the drill string in the hole. A premeasured quantity of cement slurry is pumped into the casing followed by a cementing plug 590 which separates the cement from the working or displacement fluid and also wipes the interior of the casing wall clean of cement. Working fluid is pumped into the casing behind the cementing plug 590 until all of the cement is forced out through the cementing shoe 594 and up the outer annulus 606. At this point, the cementing plug 590 seats in the cementing shoe 594, sealing off the passage therethrough and indicating to the operator at the ground surface that the second stage of cementing is ready to begin.

The drill string 572 is then run in the casing 580 to begin the subsequent cementing stages. The circulating valve 570 is in the closed position when running the drill string in the hole. A by-pass channel or passage 608 is provided in the isolation packer structure to allow fluid flow around the sealing cups of the packers 582 and 584, and through the by-pass passage 608 as the drill pipe string 572 is lowered or raised within the casing string 580. Fluid can enter the drill pipe string since it is free to flow past the lower sealing cup 584 and into the drill pipe through one or more ports 610 connecting the interior of the drill pipe to the outside of the isolation packer structure between the two sets of sealing cups of the packers 582 and 584. This will allow the drill pipe to fill as it enters the hole thereby canceling the natural tendency of the pipe to be buoyant in the working fluid. Fluid could not otherwise enter the drill string because of the bull plug 604 sealing the lower end of the drill string.

The drill string 572 is lowered in the casing far enough to pass through the inflation packer apparatus 300 at the next stage to be cemented. The lower packer 584, closing positioner 346, upper packer 582, circulating valve 570, and opening positioner 344 all pass downwardly through the apparatus 300, which apparatus is initially in the closed position. The drill string is then lifted sufficiently to bring the opening positioner 344 into engagement with the valve sleeve 304 thereby opening it and aligning the ports 312 and 310. The closing positioner 346 is also drawn up through the apparatus 300 but the lower packer 584 is not. The circulating valve 570 is then closed and working or displacing fluid is pumped down the drill string to inflate the tubular inflatable packer unit 484 as the pressurized fluid flows from the drill string and out one or more ports 610 in the packer mandrel 612 of the upper packer 582. As discussed above, the pressurized fluid flows through the aligned ports 310 and 312 of the apparatus 300 and past the resilient annular check valve member 520 to inflate the inflatable packer unit 484. The working fluid is prevented from traveling up the inner annulus 578 by the packer 582 and from traveling down the inner annulus 578 by the packer 584.

When a sufficient differential pressure is applied across the piston valve member 502, the retaining shear pins 510 are sheared and the valve member 502 moves upwardly communicating the interior of the casing string with the outer annulus 606 via the ports 312, 310 and 496. At this point cement slurry is pumped down the drill string and through the ports 610 thereof and through the ports 310, 312 and 496 into the outer annulus 606 to achieve cementing of the second stage above the inflated tubular inflatable packer unit 484.

After a predetermined amount of cement has been pumped into the annulus 606 in the second stage, the drill string is set down enough to pass the closing positioner 346 through the apparatus 300, thereby engaging the valve sleeve 304 and moving it down into the closed position. Excess cement remaining in the drill string and in the section of the inner annulus 578 between the packers is then reversed out by pumping working fluid down the inner annulus 578, through the by-pass channel 608 in the isolation packer mandrel 612, into the inner annulus 578 below the lower packer 584, up past the packer 584 forcing the excess cement back through the ports 610 and into the drill string 576 where it is carried by working fluid to the surface and out of the drill string.

FIG. 17 illustrates a method of cementing all the stages, including the first stage, through the drill string 572 when the outer annulus 606 is not filled with fluid as was the case previously illustrated in FIG. 16. In the operation illustrated in FIG. 17, the drill string 572 is run in the casing 580 until it seats on the cementing shoe 594 and is placed in fluid-tight communication therewith by the sealing adapter 602 which may be initially attached to either the drill string 572 or the cementing shoe 594. The drill string contains the elements as did the drill string illustrated in FIG. 16 except for the bull plug 604 which is not needed in this operation.

A predetermined quantity of cement slurry is then pumped downwardly through the drill string 572 and out through the cementing shoe 594 into the outer annulus 606. When the desired amount of cement has been pumped into the drill string 572, two latch-down plugs 614 and 616 are placed in the drill string 572 behind the cement and working fluid is pumped in behind the first latch-down plug 614.

As the two latch-down plugs 614 and 616 are pumped down the drill string 572, the first latch-down plug 614 latches into the cementing shoe 594, or float collar if such is being used, to provide a second back pressure valve in addition to the check valve 596 in the cementing float shoe 594. If the fluid level in the hole is low, the latch-down plug 614 will also serve to prevent the overbalance of fluid inside the drill string 572 from flowing downwardly through the float shoe 594 forcing the cement up the casing annular area 606 beyond the casing float shoe where it is imperative that an uncontaminated, durable quantity of cement be present to assure proper cementing of the lower end of the casing. The latch-down plug 614 also provides a signal to the ground surface by causing a rise in drill string pressure indicating that the first stage of cementing is completed and the second stage is ready to begin. The second latch-down plug 616 may be entered into the drill string 572 immediately behind the first latch-down plug 614 or, alternately, after the latch-down plug 614 has landed in the cementing float shoe 594. The drill string or pipe 572 is then raised to break the fluid-tight seal with the sealing adapter 602 of the cementing shoe 594, thereby allowing the second latch-down plug 616 to be pumped to a shut-off position in the lower end of the drill pipe string 572 sealing off the pressure of fluid therethrough. The inside diameter of the latch-down seat in the end of the drill pipe string 572 is necessarily larger than the inside diameter of the latch-down seat provided at the top of the float shoe 594 for securing the first latch-down plug 614.

The drill string 572 is then lifted up through the inflation packer apparatus 300 at the next stage to be cemented and the method is continued in a manner identical to that method previously described above for the second stage cementing illustrated in FIG. 16. The latch-down plug 616 remains in the drill string 572 and serves the same purpose as the bull plug 604 illustrated in FIG. 16. The process is repeated for each additional cementing stage until the cementing of the casing string 580 is completed.

Thus by the use of the methods and apparatus of the present invention, a smooth, uniform homogenous sheath of cement can be applied to the outer annulus in a casing lined well bore overcoming the difficulties of the prior art.

Although specific preferred embodiments of the present invention have been described in the detailed description above, the description is not intended to limit the invention to the particular forms or embodiments disclosed herein as they are to be recognized as illustrative rather than restrictive and it will be readily apparent to those skilled in the art that the invention is not so limited. For example, hollow cementing plugs could be used in the above-described invention rather than solid plugs which have to be inserted in the pipe from the top. The hollow plugs would be placed in the casing and the drill string prior to being inserted in the borehole and could be activated by dropping balls or plugs into seats in the hollow plugs, pressuring up the tubing and shearing the shear pins holding the cementing plugs in place. It would also be possible to alter the distance behind the opening and closing positioners 344 and 346 to gain more latitude in the lifting up and setting down steps of the operations employed with the inflation packer apparatus 300.

It should be noted that even after closing the ports 310, the hydrostatic pressure exerted by the column of cement and other fluids in the annulus 578 above the inflation packer assembly 472 is continuously applied to the annular cavity 560 and maintained by the check valve member 520 resulting in a firm grip and seal between the packer apparatus 300 and the well bore.

It should further be noted that the apparatus or tool 300 may be actuated to open and close the cementing ports therein an unlimited number of times through vertical manipulation of the opening and closing positioners 344 and 346. This feature permits each tool 300 in the casing string to be cemented to be test cycled between open and closed positions any number of times prior to beginning the cementing operation. This feature further permits the performance of suitable pressure tests at the tool 300 after cementing therethrough to assure proper cementing at the associated stage. Also, additional cement may be pumped through the reopened tool 300 in the event it might become necessary for some reason such as unexpected loss of cement in the adjacent formation.

If desired, a full opening multiple stage cementing tool as described in U.S. Pat. No. 3,768,562 may be installed in a casing string near the upper end of the first cementing stage. Such a tool is shown in FIGS. 14, 15, 16 and 17 installed in the casing string 580 and is designated by the reference character 618. After cementing the first stage, the full opening tool 618 may be moved from the initially closed position to the open position by the opening positioner 344 and the extent of the first stage of cementing 620 checked by applying pressure to the open ports thereof by attempting to circulate therethrough. In this manner each stage of the multiple stage cementing operation can be tested and/or supplemented utilizing the tool 618 for the first stage at the bottom end of the casing string and utilizing the tool 618 or the tool 300 at each successive cementing stage throughout the full length of the casing string 580. After testing or supplementary cementing the full opening tool 618 may be moved from the open position back to the closed position by the closing positioner 346.

It is further contemplated that, with regard to the inflation packer apparatus 300, the collet fingers 388 on the lower end of the valve sleeve 304 could be replaced by one or more circular rings placed around the valve sleeve 304 in grooved channels formed in the outer periphery thereof, which rings would project outwardly from the valve sleeve wall and act as spring clips sliding in and out of corresponding annular grooves having tapered end walls formed in the inner periphery of the tubular outer case 302 as the valve sleeve 304 is moved upwardly and downwardly within the outer case 302. Such structure could also be substituted for the collet finger structure employed in the inflation packer apparatus 10. It should also be noted that, where seals having polygonal cross-sections are revealed, O-ring seals or other type annular seal members could be readily substituted therefor. Likewise, various other releasable securing means or shear means could be substituted for the shear pins disclosed in the preferred embodiments.

The invention is declared to cover all changes and modifications of the specific examples of the invention herein disclosed for purposes of illustration, which do not constitute departures from the spirit and scope of the invention.

What is claimed is:

1. In a cementing packer tool for cementing through a tubular string in a well bore of the type which includes a tubular housing having at least one port extending through the wall thereof; means for interposing the tubular housing between adjacent sections of the tubular string and securing the housing thereto in communication therewith; sleeve valve means slidably disposed within the tubular housing for alternately opening and closing the port in the tubular housing to fluid flow therethrough in response to manipulation signals from the ground surface; means operatively engaging the sleeve valve means and the tubular housing for releasably maintaining the sleeve valve means in a condition opening the port in the tubular housing; and means operatively engaging the sleeve valve means and the tubular housing for releasably maintaining the sleeve valve means in a condition closing the port in the tubular housing; the improvement comprising:

a tubular inflation packer assembly having an upper end portion and a lower end portion, the lower end portion sealingly engaging the outer periphery of said tubular housing a distance below the port through the wall thereof, the upper end portion defining an annular space between the inner periphery of said inflation packer assembly and the outer periphery of said tubular housing communicating with and extending upwardly from the port through the wall of said tubular housing and having at least one port formed in the upper portion communicating between the annular space and the outer periphery of said tubular inflation packer assembly, said tubular inflation packer assembly further including:

means for providing an annular seal between the inner periphery of said tubular packer assembly and the outer periphery of said tubular housing intermediate the port formed in said tubular housing and the lower end portion of said inflation packer assembly for allowing one-way downward fluid flow therepast while preventing upward fluid flow therepast;

a tubular member carried by said tubular packer assembly and extending between the lower portion thereof and the upper portion thereof adjacent said means for providing an annular seal and defining a closed annular chamber between the inner periphery of said tubular inflation packer assembly and the exterior of said tubular housing intermediate the lower end portion thereof and said means for providing an annular seal;

a tubular resilient packer sealing member formed on the outer periphery of said tubular member; and pressure responsive valve means interposed between the port in said tubular housing and the port formed in the upper end portion of said tubular inflation packer assembly for preventing fluid communication between the port in said tubular housing and the port in said inflation packer assembly and, alternately, placing said ports in fluid communication in response to the application of a predetermined pressure differential across said valve means.

2. A cementing packer tool for cementing through a pipe string or casing comprising:

a tubular housing containing one or more outer cementing ports through the wall thereof;

means for interposing said tubular housing between pipe sections of a string of pipe and attaching said housing to the pipe;

a closing sleeve slidably located within said tubular housing and containing one or more inner cementing ports through the wall thereof;

said closing sleeve in one position allowing said outer ports and said inner ports to communicate therethrough and in a second position isolating said inner ports from said outer ports;

said closing sleeve having a large unrestricted bore therethrough with a relatively constant inner diameter substantially equivalent to the inner diameter of the pipe string or casing;

an opening sleeve slidably located within said closing sleeve and covering said inner ports in a first position and uncovering said ports in a second position;

said opening sleeve having a large unrestricted bore therethrough of substantially constant diameter and slightly smaller in diameter than said closing sleeve;

spring means on said closing sleeve engaging said housing, said spring means adapted to retain said closing sleeve in an open-port position until sufficient force is applied downwardly on said sleeve to overcome said spring means;

a releasing sleeve slidably located within said closing sleeve and arranged in a first upper position to maintain said spring means engaged in said housing and in a second position to release said spring means and engage said closing sleeve to move it downwardly;

said releasing sleeve having a large unrestricted bore therethrough with a substantially constant inner diameter which is slightly smaller than the diameter of the pipe string or casing;

a sleeve retainer fixedly located within said closing sleeve and adapted to limit downward movement of said opening sleeve;

said retainer having an open unrestricted bore therethrough substantially equal to that of the opening sleeves;

first shear means contained in said closing sleeve and said opening sleeve, attaching said opening sleeve to said closing sleeve and arranged to maintain said opening sleeve covering said inner ports;

second shear means contained in said releasing sleeve and said closing sleeve and attaching said releasing sleeve to said closing sleeve;

means for selectively shearing said first and second shear means further comprising first activating means and second activating means, said first activating means further adapted to fluidically seal the bore of said opening sleeve and said second activating means adapted to fluidically seal the bore of said releasing means, said first activating means arranged to shear said first shear means and said activating means arranged to shear said second shear means;

recess means in the exterior surface of the lower end of said releasing sleeve, said recess means arranged to prevent fluid lock between said first activating means and said second activating means by fluidically communicating between said outer and inner cementing ports and the area trapped between said first and second activating means;

a tubular inflation packer assembly having an upper end portion and a lower end portion, the lower end portion sealingly engaging the outer periphery of said tubular housing a distance below the outer cementing ports through the wall thereof, the upper end portion defining an annular space between the inner periphery of said inflation packer assembly and the outer periphery of said tubular housing communicating with and extending upwardly from the outer cementing ports through the wall of said tubular housing and having at least one cementing port formed in the upper portion communicating between the annular space and the outer periphery of said tubular inflation packer assembly, said tubular inflation packer assembly further including:

means for providing an annular seal between the inner periphery of said tubular packer assembly and the outer periphery of said tubular housing below the outer cementing ports in said tubular housing and allowing one-way downward fluid flow therepast while preventing upward fluid flow therepast;

a tubular deformable member carried by said tubular packer assembly and extending between the lower portion thereof and the upper portion thereof adjacent said means for providing an annular seal and defining a closed annular chamber between the inner periphery of said tubular inflation packer assembly and the exterior of said tubular housing intermediate the lower end portion thereof and said means for providing an annular seal;

a tubular resilient packer sealing member formed on the outer periphery of said tubular deformable member; and pressure responsive valve means interposed between the outer cementing ports of said tubular housing and the cementing ports formed in the upper end portion of said tubular inflation packer assembly for preventing fluid communication between the outer cementing ports of said tubular housing and the cementing ports of said inflation packer assembly and, alternately, placing said ports in fluid communication in response to the application of a predetermined pressure differential across said valve means.

3. The cementing packer tool as defined in claim 2 wherein said tubular deformable member is characterized further as comprising:

a relatively thin, tubular, solid, metallic membrane formed in said tubular packer assembly and extending between the lower portion thereof and the upper portion thereof adjacent said means for providing an annular seal.

4. Oil well cementing apparatus capable of cementing any number of annulus cementing stages and adapted to be interposed between sections of oil well casing comprising:

one or more sliding sleeve cementing valves adapted to be interconnected within a casing string, each of said valves comprising ported sliding inner sleeve means and a ported stationary outer housing, said sleeve valves each being movable from a closed position to an open position and from an open position to a closed position an indefinite number of times, each said valve adapted to be located in said casing string at a respective cementing stage location;

opening means adapted to be arranged axially on a rigid tubular member disposed within and longitudinally movable within the casing string and longitudinally movable through said cementing valves, said opening means adapted to engage said inner sleeve means for moving said inner sleeve means to a valve-open position;

closing means adapted to be arranged axially on a rigid tubular member disposed within and longitudinally movable within the casing string and longitudinally movable through said cementing valves, said closing means adapted to engage said inner sleeve means for moving said inner sleeve means to a valve-closed position;

a tubular inflation packer assembly having an upper end portion and a lower end portion, the lower end portion sealingly engaging the outer periphery of said outer housing a distance below the ports formed therein, the upper end portion defining an annular space between the inner periphery of said inflation packer assembly and the outer periphery of said outer housing communicating with and extending upwardly from the ports formed in said outer housing and having at least one port formed in the upper portion communicating between the annular space and the outer periphery of said tubular inflation packer assembly, said tubular inflation packer assembly further including:

means for providing an annular seal between the inner periphery of said tubular packer assembly and the outer periphery of said outer housing below the ports in said outer housing and allowing one-way downward fluid flow therepast while preventing upward fluid flow therepast;

a tubular deformable member carried by said packer assembly and extending between the lower portion thereof and the upper portion thereof adjacent said means for providing an annular seal and defining a closed annular chamber between the inner periphery of said tubular inflation packer assembly and the exterior of said outer housing intermediate the lower end portion of said inflation packer assembly and said means for providing an annular seal, a tubular resilient packer sealing member formed on the outer periphery of said tubular deformable member; and pressure responsive valve means interposed between the ports of said outer housing and the ports formed in the upper end portion of said tubular inflation packer assembly for preventing fluid communication between the ports of said outer housing and the ports of said inflation packer assembly and, alternately, placing said ports in fluid communication in response to the application of a predetermined pressure differential across said valve means.

5. A full opening cementing tool for multiple stage oil well cementing comprising:

an outer cylindrical housing having a plurality of ports through the wall thereof;

a valve sleeve located telescopically within said housing and having a plurality of ports through the wall thereof capable of fluid communication with said ports in said housing in a first open position and fluid isolation from said housing ports in a second closed position;

spring tension means between said housing and said sleeve for releasably securing said valve sleeve in the first open position and, alternately, for releasably securing said valve sleeve within said housing in the second closed position;

means attached to said housing for inserting said housing into a casing string;

first means for engaging said sleeve and moving said sleeve from the first open position to the second closed position;

second means for engaging said sleeve and moving said sleeve from the second closed position to the first open position, said first and second means for engaging said sleeve being fixedly secured to a rigid tubular member located concentrically within said sleeve and axially movable within said sleeve;

a tubular inflation packer assembly having an upper end portion and a lower end portion, the lower end portion sealingly engaging the outer periphery of said outer cylindrical housing a distance below the ports formed therien, the upper end portion defining an annular space between the inner periphery of said inflation packer assembly and the outer periphery of said outer cylindrical housing communicating with and extending upwardly from the ports through the wall of said outer cylindrical housing and having at least one cementing port formed in the upper portion communicating between the annular space and the outer periphery of said tubular inflation packer assembly, said tubular inflation packer assembly further including:

means for providing an annular seal between the inner periphery of said tubular packer assembly and the outer periphery of said outer cylindrical housing below the ports in said outer cylindrical housing and allowing one-way downward fluid flow therepast while preventing upward fluid flow therepast;

a tubular deformable member carried by said packer assembly and extending between the lower portion thereof and the upper portion thereof adjacent said means for providing an annular seal and defining a closed annular chamber between the inner periphery of said tubular inflation packer assembly and the exterior of said outer cylindrical housing intermediate the lower end portion of said inflation packer assembly and said means for providing an annular seal;

a tubular resilient packer sealing member formed on the outer periphery of said tubular deformable member; and pressure responsive valve means interposed between the ports of said outer cylindrical housing and the cementing ports formed in the upper end portion of said tubular inflation packer assembly for preventing fluid communication between the ports of said outer cylindrical housing and the cementing ports of said inflation packer assembly and, alternately, placing said ports in fluid communication in response to the application of a predetermined pressure differential across said valve means.

6. The full opening cementing tool as defined in claim 5 wherein said tubular deformable member is characterized further as comprising:

a relatively thin, tubular, solid, metallic membrane formed in said packer assembly and extending between the lower portion thereof and the upper portion thereof adjacent said means for providing an annular seal.

7. In an oil well cementing apparatus for cementing any number of annulus cementing stages and adapted to be interposed between sections of oil well casing of the type which includes one or more sliding sleeve cementing valves adapted to be interconnected within a casing string, each of said cementing valves comprising ported sliding inner sleeve means and a ported stationary outer housing, said sleeve cementing valves each being movable from a closed position to an open position and from an open position to a closed position an indefinite number of times, each said valve adapted to be located in said casing string at a respective cementing stage location; opening means adapted to be arranged axially on a rigid tubular member disposed within and longitudinally movable within the casing string and longitudinally movable through said cementing valves, said opening means adapted to engage said inner sleeve means for moving said inner sleeve means to a valve-open position; and closing means adapted to be arranged axially on a rigid tubular member disposed within and longitudinally movable within the casing string and longitudinally movable through said cementing valves, said closing means adapted to engage said inner sleeve means for moving said inner sleeve means to a valve-closed position; the improvement comprising:

a tubular inflation packer assembly having an upper end portion and a lower end portion, the lower end portion sealingly engaging the outer periphery of said outer housing a distance below the ports formed therein, the upper end portion defining an annular space between the inner periphery of said inflation packer assembly and the outer periphery of said outer housing communicating with and extending upwardly from the ports formed in said outer housing and having at least one port formed in the upper portion communicating between the annular space and the outer periphery of said tubular inflation packer assembly, said tubular inflation packer assembly further including:

means for providing an annular seal between the inner periphery of said tubular packer assembly and the outer periphery of said outer housing below the ports in said outer housing and allowing oneway downward fluid flow therepast while preventing upward fluid flow therepast;

a tubular deformable member carried by said packer assembly and extending between the lower portion thereof and the upper portion thereof adjacent said means for providing an annular seal and defining a closed annular chamber between the inner periphery of said tubular inflation packer assembly and the exterior of said outer housing intermediate the lower end portion of said inflation packer assembly and said means for providing an annular seal;

a tubular resilient packer sealing member formed on the outer periphery of said tubular deformable member; and pressure responsive valve means interposed between the ports of said outer housing and the ports formed in the upper end portion of said tubular inflation packer assembly for preventing fluid communication between the ports of said outer housing and the ports of said inflation packer assembly and, alternately, placing said ports in fluid communication in response to the application of a predetermined pressure differential across said valve means.

8. A method of cementing the outer casing annulus between a casing string and a well bore in any desired number of stages wherein the casing string in the well bore includes a predetermined number of casing valves located in the casing wall at predetermined locations with an inflatable packer member disposed about at least one of the casing valves with the interior of the packer member communicating with the respective casing valve passage and with initially closed pressure responsive valve means interposed between the interior of the packer member and the outer casing annulus above the packer member, comprising the steps of:

a. closing the interior of the casing string at a point below the lowermost of said casing valves;

b. opening the lowermost of said casing valves to provide a fluid communication channel between the interior of the casing and the interior of the inflatable packer member;

c. pumping a quantity of working fluid downwardly through the casing and through the open casing valve into the interior of the inflatable packer member;

d. applying pressure to the working fluid until the inflatable packer member inflates and provides sealing engagement between the exterior of the casing and the well bore;

e. continuing to apply additional pressure to the working fluid until the pressure responsive valve means opens providing fluid communication between a portion of the interior of the inflatable packer member and the annulus between the casing and the well bore above the inflated packer member while maintaining fluid pressure within the remaining portion of the interior of the inflated packer member to provide continued sealing engagement between the exterior of the casing and the well bore;

f. pumping a quantity of cement slurry downwardly through the casing and through the open casing valve and open pressure responsive valve means of the inflatable packer member into the annulus between the exterior of the casing and the well bore above the inflated inflatable packer member forming an additional cementing stage of the outer casing annulus; and g. closing said casing valve against additional fluid flow therethrough.

9. A method of cementing the outer casing annulus between a casing string and a well bore in any desired number of stages wherein the casing string in the well bore includes a predetermined number of casing valves located in the casing wall at predetermined locations with an inflatable packer member disposed about at least one of the casing valves with the interior of the packer member communicating with the respective casing valve passage and with initially closed pressure responsive valve means interposed between the interior of the packer member and the outer casing annulus above the packer member, comprising the steps of:

a. flowing a quantity of cement slurry down through the interior of the well casing, out the bottom of the casing and back up the annulus between the casing and the well bore;

b. inserting a wiper plug in the casing immediately behind said cement slurry;

c. pumping a working fluid behind the wiper plug, said fluid having a consistency and specific gravity near that of said cement slurry, thereby forcing the wiper plug and cement slurry to the bottom of the casing;

d. applying pressure to the working fluid until the wiper plug seats in sealing engagement in the bottom of the casing;

e. opening the lowermost of said casing valves to provide a fluid communication channel between the interior of the casing and the interior of the inflatable packer member;

f. pumping a quantity of working fluid downwardly through the casing and through the open casing valve into the interior of the inflatable packer member;

g. applying pressure to the working fluid until the inflatable packer member inflates and provides sealing engagement between the exterior of the casing and the well bore;

h. continuing to apply additional pressure to the working fluid until the pressure responsive valve means opens providing fluid communication between a portion of the interior of the inflatable packer member and the annulus between the casing and the well bore above the inflated packer member while maintaining fluid pressure within the remaining portion of the interior of the inflated packer to provide continued sealing engagement between the exterior of the casing and the well bore;

i. pumping a quantity of additional cement slurry downwardly through the casing and through the open casing valve and open pressure responsive valve means of the inflatable packer member into the annulus between the exterior of the casing and the well bore above the inflated inflatable packer member forming an additional cementing stage of the outer casing annulus; and j. closing said casing valve against additional fluid flow therethrough.

10. The method as defined in claim 9 characterized further to include the additional steps of:

k. opening the casing valve next above in the casing string having an inflatable packer member disposed thereabout to provide a fluid communication channel between the interior of the casing and the interior of the inflatable packer; and l. repeating steps (f) through (j) at said next casing valve until all stages of cementing in the outer casing annulus have been completed.

11. A method of cementing the outer casing annulus between a casing string and a well bore in any desired number of stages wherein the casing string in the well bore includes a predetermined number of casing valves located in the casing wall at predetermined locations with an inflatable packer member disposed about at least one of the casing valves with the interior of the packer member communicating with the respective casing valve passage and with pressure responsive valve means interposed between the interior of the packer member and the outer casing annulus above the packer member, comprising the steps of:

a. flowing a quantity of cement slurry downwardly through the interior of the casing string, out the bottom of the casing string and back up the outer casing annulus between the casing string and the well bore;

b. inserting a wiper plug in the casing string immediately behind said quantity of cement slurry;

c. pumping a working fluid behind the wiper plug, said fluid having a consistency and specific gravity near that of said cement slurry, thereby forcing the wiper plug and cement slurry to the bottom of the casing string;

d. applying pressure to the working fluid until the wiper plug seats in sealing engagement in the bottom of the casing string;

e. inserting a first fluid-tight sealing member at the lowermost closed casing valve having an inflatable packer member disposed thereabout to close the interior of the casing string;

f. pumping a quantity of working fluid downwardly through the casing string to the first fluid-tight sealing member at the casing valve;

g. applying pressure to said quantity of working fluid above the first fluid-tight sealing member to open the adjacent casing valve and provide a fluid communication channel between the interior of the casing string and the interior of the inflatable packer member;

h. pumping an additional quantity of working fluid downwardly through the casing string and through the open casing valve into the interior of the inflatable packer member;

i. applying pressure to the additional quantity of working fluid until the inflatable packer member inflates and provides annular sealing engagement between the exterior of the casing string and the well bore;

j. applying additional pressure to the additional quantity of working fluid until the pressure responsive valve means opens providing fluid communication between a portion of the interior of the inflatable packer member and the outer casing annulus between the casing string and the well bore of the inflatable packer member while maintaining fluid pressure within the remaining inflated portion of the inflatable packer member to provide continued annular sealing engagement between the exterior of the casing string and the well bore;

k. pumping a quantity of additional cement slurry downwardly through the casing string and through the open casing valve and open pressure responsive valve means of the inflatable packer member into the outer casing annulus between the exterior of the casing string and the well bore above the inflated inflatable packer member forming an additional stage of cement in the outer casing annulus;

l. inserting a second fluid-tight sealing member behind the quantity of additional cement slurry;

m. pumping an additional quantity of working fluid downwardly through the casing string behind the second fluid-tight sealing member until a second fluid-tight seal is provided at the open casing valve to again close the interior of the casing string; and n. applying pressure to the additional quantity of working fluid above the open casing valve to close the open casing valve to fluid communication therethrough.

12. The method as defined in claim 11 characterized further to include the additional step of:

applying the hydrostatic pressure of the column of cement slurry and other fluids in the outer casing annulus above the inflated inflatable packer member to the interior of the inflated inflatable packer member to maintain continued annular sealing engagement between the exterior of the casing string and the well bore.

13. The method as defined in claim 11 characterized further to include the additional steps of:

repeating steps (e) through (n) at the casing valve next above in the casing string having an inflatable packer member disposed thereabout until all stages of cementing in the outer casing annulus have been completed.

14. A method of cementing the outer casing annulus of a well bore in any desired number of stages wherein the casing in the well bore includes a predetermined number of casing valves located in the casing wall at predetermined locations with an inflatable packer member disposed about at least one of the casing valves with the interior of the packer member communicating with the respective casing valve passage and with pressure responsive valve means interposed between the interior of the packer member and the outer casing annulus, comprising the steps of:

a. flowing a precalculated quantity of cement slurry downwardly through the interior of the well casing, out the bottom of the casing and back up the annulus between the casing and the well bore;

b. inserting a wiper plug in the casing immediately behind said cement slurry;

c. pumping a working fluid behind the wiper plug, said fluid having the consistency and specific gravity near that of said cement slurry, thereby forcing the wiper plug and cement slurry to the bottom of the casing;

d. applying pressure to said working fluid until the wiper plug seats in sealing engagement in the bottom of the casing thereby causing a perceptible rise in fluid pressure in the casing;

e. running in a string of tubular pipe in the well casing, said string of pipe having an opening positioner and a closing positioner located thereon;

f. engaging said opening positioner in the lowermost of said casing valves having an inflatable packer member disposed thereabout and thereby opening said valve and providing a fluid communication channel between the interior of the casing and the interior of the temporarily sealed inflatable packer member;

g. pumping a quantity of working fluid down through the interior of the pipe string and out the bottom end of the pipe whereby said working fluid flows through the open casing valve and into the interior of the temporarily sealed inflatable packer member;

h. applying pressure to the working fluid until the inflatable packer member inflates to provide sealing engagement between the exterior of the casing string and the well bore;

i. continuing to apply additional pressure to the working fluid until the pressure responsive valve means opens providing fluid communication between a portion of the interior of the inflatable packer member and the annulus between the casing string and the well bore above the inflated packer member while maintaining fluid pressure within the remaining portion of the interior of the inflated packer member;

j. pumping a predetermined quantity of additional cement slurry downwardly through the interior of the pipe string and out the bottom end of the pipe through the open casing valve and past the open pressure responsive valve means of the inflatable packer member and into the annulus between the exterior of the casing string and the well bore above the inflated inflatable packer member forming an additional cementing stage of the exterior casing annulus; and k. engaging said closing positioner in said lowermost casing valve and thereby closing said valve against additional fluid flow therethrough.

15. The method as defined in claim 14 characterized further to include the additional step of:

lifting the string of pipe upwardly through the casing from the previously cemented stage.

16. The method as defined in claim 14 characterized further to include the additional steps of:

l. lifting the string of pipe to the next adjacent area of casing to be cemented, which area contains another casing valve having an inflatable packer member disposed thereabout; and m. repeating steps (f) through (l) until all stages of cementing in the exterior casing annulus have been completed.

17. The method as defined in claim 14 characterized further to include the additional step of:

engaging the opening positioner in a casing valve adjacent a cementing stage of the exterior casing annulus and thereby opening said valve and providing a fluid communication channel between the interior of the casing and the cementing stage adjacent thereto.

18. The method as defined in claim 17 characterized further to include the additional step of:

applying fluid pressure through the interior of the casing and said open casing valve to the cementing stage adjacent thereto to test the cementing stage.

19. The method as defined in claim 18 characterized further to include the additional step of:

engaging said closing positioner in said open casing valve and thereby closing said valve against fluid flow therethrough.

20. The method as defined in claim 18 characterized further to include the additional step of:

pumping a predetermined additional quantity of cement slurry downwardly through the interior of the pipe string and outwardly of the pipe string and outwardly therefrom through said open casing valve to provide additional cement to the cementing stage adjacent thereto.

21. The method as defined in claim 20 characterized further to include the additional step of:

engaging said closing positioner in said open casing valve and thereby closing said valve against fluid flow therethrough.

* * * * *